US005424810A

United States Patent [19]

Tomiyama et al.

[11] Patent Number: 5,424,810

[45] Date of Patent: Jun. 13, 1995

[54] MAGNETIC TONER, MAGNETIC DEVELOPER, APPARATUS UNIT, IMAGE FORMING APPARATUS AND FACSIMILE APPARATUS

[75] Inventors: Koichi Tomiyama, Kawasaki; Hiroyuki Suematsu, Yokohama; Masayoshi Kato, Iruma; Hiroshi Yusa, Yokohama; Takakuni Kobori, Kawasaki, all of Japan

[73] Assignee: Canon Kabushiki Kaisha, Tokyo, Japan

[21] Appl. No.: 942,840

[22] Filed: Sep. 10, 1992

[30] Foreign Application Priority Data

Sep. 13, 1991 [JP] Japan ..... 3-234696
Jun. 2, 1992 [JP] Japan ..... 4-165515

[51] Int. Cl.[6] ..... G03G 15/09

[52] U.S. Cl. ..... 355/251; 118/657; 252/62.54; 252/62.59; 358/301; 430/106.6

[58] Field of Search ..... 355/251, 245; 118/653, 118/657, 658; 252/62.54, 62.59; 430/106.6; 358/296, 301

[56] References Cited

U.S. PATENT DOCUMENTS

| | | | |
|---|---|---|---|
| 2,221,776 | 11/1940 | Carlson | 430/148 |
| 2,297,691 | 10/1942 | Carlson | 430/255 |
| 2,618,552 | 11/1952 | Wise | 430/121 |
| 2,874,063 | 2/1959 | Greig | 252/62.53 |
| 3,666,363 | 5/1972 | Tanaka et al. | 355/17 |
| 3,720,617 | 3/1973 | Chatterji et al. | 252/62.1 |
| 3,819,367 | 6/1974 | Chatterji et al. | 430/120 |
| 3,909,258 | 9/1975 | Kotz | 430/122 |
| 3,942,979 | 3/1976 | Jones et al. | 430/120 |
| 3,969,251 | 7/1976 | Jones et al. | 252/62.1 P |
| 4,071,361 | 1/1978 | Marushima | 430/54 |
| 4,299,900 | 11/1981 | Mitsuhashi et al. | 430/122 |
| 4,395,476 | 7/1983 | Kanbe et al. | 430/102 |
| 4,543,312 | 9/1985 | Murakawa et al. | 252/62.54 X |
| 4,820,603 | 4/1989 | Sakashita | 430/106.6 |
| 4,975,214 | 12/1990 | Sakashita et al. | 252/62.59 |
| 5,009,973 | 4/1991 | Yoshida et al. | 430/106.6 X |
| 5,053,305 | 10/1991 | Aoki et al. | 430/106.6 X |

FOREIGN PATENT DOCUMENTS

| | | |
|---|---|---|
| 0187434 | 7/1986 | European Pat. Off. . |
| 0247884 | 12/1987 | European Pat. Off. . |
| 46-5782 | 12/1971 | Japan . |
| 48-47345 | 7/1973 | Japan . |
| 48-47346 | 7/1973 | Japan . |
| 51-3244 | 1/1976 | Japan . |
| 54-72054 | 6/1979 | Japan . |
| 55-18656 | 2/1980 | Japan . |
| 58-129437 | 8/1983 | Japan . |
| 61-34070 | 2/1986 | Japan . |
| 62-279352 | 12/1987 | Japan . |
| 63-139367 | 6/1988 | Japan . |
| 63-139369 | 6/1988 | Japan . |
| 3-9045 | 2/1991 | Japan . |
| 1402010 | 8/1975 | United Kingdom . |

OTHER PUBLICATIONS

Patent Abstracts of Japan, vol. 13, No. 554 (P-973)(3902), Dec. 11, 1989.

Patent Abstracts of Japan, vol. 12, No. 172 (C-497)(3019), May 21, 1988.

Database WPIL, Section Ch, Week 4189, Derwent Publications, Class A12 AN 89-298038 (41).

*Primary Examiner*—A. T. Grimley

*Assistant Examiner*—Shuk Y. Lee

*Attorney, Agent, or Firm*—Fitzpatrick, Cella, Harper & Scinto

[57] ABSTRACT

A magnetic toner for electrophotography is composed from a binder resin and a silicon-containing magnetic iron oxide. The magnetic toner has a weigh-average particle size o at most 13.5 μm and has a particle size distribution such that it contains o more than 50 wt, % of magnetic toner particles having a particle size of at least 12.7 μm. The magnetic toner is able to show high developing performances because of richness in fine particles and is also provided with an improved environmental stability because the magnetic iron oxide used therein contains 0.5–4 wt, % silicon (based on total iron content) and has a specific silicon distribution such that the magnetic iron oxide has a total silicon content (A), a silicon content (B) dissolved together with the magnetic iron oxide when the magnetic iron oxide is dissolved up to 20 wt, % dissolution of iron, and a superficial silicon content (C), satisfying relations of B/A=44–84% and C/A=10–55%. The performances are enhanced if the magnetic toner is blended with additives such as inorganic fine powder or resin fine particles.

132 Claims, 7 Drawing Sheets

MAGNETIC TONER, MAGNETIC DEVELOPER, APPARATUS UNIT, IMAGE FORMING APPARATUS AND FACSIMILE APPARATUS

FIELD OF THE INVENTION AND RELATED ART

The present invention relates to a magnetic toner and a magnetic developer for visualizing electrostatic images in image forming methods, such as electrophotography and electrostatic recording, and also an apparatus unit, an image forming apparatus and a facsimile apparatus including such a magnetic toner or magnetic developer.

Hitherto, a large number of electrophotographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after transferred onto paper, etc., as desired, fixed by heating, pressing, heating and pressing, etc.

Various developing methods for visualizing electrostatic latent images with toner have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, those developing methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner, have been proposed. Among these, there are many excellent developing methods using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image to effect development. In this method,as the development zone, an electroconductive path is formed with toner particles between the recording member surface and the sleeve surface and the toner particles are attached to image portions due to a Coulomb's force exerted from the image portions to effect development. This method using an electroconductive magnetic toner is an excellent method which has obviated the problems involved in the two-component developing methods. However, as the toner is electroconductive, there is involved a problem that it is difficult to transfer the developed image electrostatically from the recording member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained.

As another method using a high resistivity magnetic toner, there are known methods wherein toner particles are triboelectrically charged through friction between toner particles or friction between a friction member such as a sleeve and toner particles, and then caused to contact an electrostatic image-bearing member to effect development, However, these methods involve problems that the triboelectric charge is liable to be insufficient because the number of friction between the toner particles and the friction member, and the charged toner particles are liable to agglomerate on the sleeve because of an enhanced Coulomb's force.

A developing method having eliminated the above described problems has been proposed in U.S. Pat. No. 4,395,476 (corresponding to Japanese Laid-Open Patent Application (JP-A) 55-18656). In this method (so-called "jumping developing method"), a magnetic toner is applied in a very small thickness on a sleeve, triboelectrically charged and is brought to an extreme vicinity to an electrostatic image to effect development. More specifically, in this method, an excellent image is obtained through such factors that a sufficient triboelectric charge can be obtained because a magnetic toner is applied onto a sleeve in a very small thickness to increase the opportunity of contact between the sleeve and the toner; the toner is carried by a magnetic force, and the magnet and the toner are moved relative to each other to disintegrate the agglomerate of the toner and cause sufficient friction between the toner and the sleeve; and the toner layer is caused to face an electrostatic image under a magnetic field and without contact to effect development.

However, the above-mentioned method using an insulating toner involves an unstable factor related to the insulating toner used. That is, an insulating toner contains a considerable account of fine powdery magnetic material, and a part of the magnetic material is exposed to the surface of a toner particle, so that the kind of the magnetic material affects the flowability and triboelectric chargeability of the magnetic toner, thus resulting in charge or deterioration of various properties, such as developing performance and successive image forming performance, of the magnetic toner.

More specifically, on continuation of the repetitive developing step (e.g., for copying) for a long period in the jumping developing method using a magnetic toner containing a conventional magnetic material, the flowability of a developer containing the magnetic toner is reduced and fails to provide the normal triboelectric charge. This results in an unstable charge, which is liable to result in serious image defects, such as a occurrence of fog, in a low temperature - low humidity environment. Further, in case of a weak adhesion between the binder resin and the magnetic material constituting magnetic toner particles, the magnetic material is liable to be lost from the surface of the magnetic toner on repetition of the developing step to result in adverse phenomena, such as a lowering in toner image density.

Further, in the case where the magnetic material is non-uniformly dispersed in magnetic toner particles, small magnetic toner particles containing much magnetic material can be accumulated on a developing sleeve to result in a lowering in image density or a density irregularity called "sleeve ghost" in some cases.

Several proposals have been made regarding magnetic iron oxide contained in a magnetic toner, but some room for improvement has been left.

For example, Japanese Laid-Open Patent Application (JP-A) 62-279352 has proposed a magnetic toner containing magnetic iron oxide containing silicon. The magnetic iron oxide contains silicon disposed intentionally in the interior of magnetic iron oxide particles. The magnetic toner containing the magnetic iron oxide has left some room for improvement regarding its flowability.

Japanese Patent Publication (JP-B) 3-9045 has proposed to control the shape of magnetic iron oxide particles to a spherical one by adding a silicic acid salt. The magnetic iron oxide particles obtained by this method contain silicon in a larger amount in their interior and in a smaller amount at their surface. As a result, the improvement in flowability of the magnetic toner is liable to be insufficient and, as the magnetic iron oxide has a high surface smoothness, the adhesion between the binder resin and magnetic iron oxide constituting the magnetic toner is liable to be insufficient.

JP-A 61-34070 has proposed a process for producing triiron tetroxide wherein a hydrosilicic acid salt solution is added during oxidization to triiron tetroxide. The triiron tetroxide produced by the process contains silicon in the vicinity of the surface and the silicon is present in the form of a layer in the vicinity of the triiron tetroxide surface. As a result, the surface of the triiron tetroxide is weak against a mechanical shock, such as rubbing.

Further, as image forming apparatus such as electrophotographic copying machines are used in recent years, the usage thereof become diverse and requirement for image quality is becoming severer. In copying of images for ordinary papers and documents, even fine characters are required to be faithfully reproduced without resolution failure or lack of images. Particularly, in case where a latent image on a photosensitive member in an image forming apparatus is composed of lines of 100 μm or thinner, a conventional developer has shown generally poor thin-line reproducibility and has resulted in line images of insufficient clarity. Further, in an image forming apparatus such as an electrophotographic printer using digital image signals, a latent image is composed as an assemble of unit dots, an image density variation ranging from solid, halftone and light is expressed by changing dot existing density. In the case where toner particles are not faithfully disposed at a dot but are present sticking out of a dot, however, it is impossible to obtain a toner image gradation corresponding to a dot density proportion between black and white portions of digital images. Further, in the case where an increased resolution is intended by using a smaller dot size so as to provide an improved image quality, it becomes more difficult to reproduce latent images composed of minute dots, the process thus being liable to result in images with poor resolution and gradation and lacking sharpness.

Further, in some cases, good images are obtained at initial stages but image quality is deteriorated on continuation of printing out. This is presumably because toner particles suitable for developing are preferentially consumed and toner particles having inferior developing performance are accumulated within the developing apparatus.

Hitherto, several developers have been proposed. JP-A 51-3244 has proposed a non-magnetic toner aiming at an improved image quality through control of particle size distribution. The toner comprises mainly particles of 8–12 μm, which is relatively coarse, and it is difficult to cover latent images uniformly and densely. Further, the broad distribution that the toner comprises which is at most 30% by number of particles of 5 μm or smaller and at most 5% by number of particles of 20 μm or larger also tends to lower the uniformity. In order to form clear images by using a toner comprising rather coarse toner particles, it is necessary that the toner particles are superposed in a large thickness to fill in clearance between toner particles so as to increase the apparent image density, thus requiring an increased toner consumption for providing a prescribed image density.

JP-A 54-72054 has proposed a non-magnetic toner having a sharper particle size distribution than the above, but the medium weight particles have sizes of 8.5–11.0 μm, which is coarse, thus leaving a room for improvement as a high-resolution toner.

JP-A 58-129437 has proposed a non-magnetic toner having an average particle size of 6–10 μm, and containing mode particles of 5–8 μm, but the particles of 5 μm or smaller are 15% by number of less, which is still few, the toner thus being liable to provide images lacking sharpness.

According to our study, it has been known that toner particles of 5 μm or smaller principally have a function of clearly reproducing a latent image contour and effecting uniform and dense coverage of the entire latent image with the toner. Particularly, in a latent image on a photosensitive member, the edge or contour portion has a higher field intensity than the inside because of concentration of electric lines of force. Accordingly, the quality of toner particles gathering at the portion determines the clearness of the resultant image. According to our study, it has been known that the problem regarding the clearness of images can be effectively solved by the amount of particles of 5 μm or smaller.

U.S. Pat. No. 4,299,900 has proposed a jumping developing method using a developer comprising 10–50 wt. % of a magnetic toner of 20–35 μm. In other words, consideration is paid to a toner particle size suitable for triboelectrically charging a magnetic toner, forming a thin layer of the toner on a sleeve and improving the environmental durability of the developer. However, a further improvement is required in response to severer requirements in respects of thin-line reproducibility, resolution and adaptability to reversal development.

In a method of using such a dry developer, it has been conventionally practiced to admix siliceous fine powder with toner powder. As siliceous fine powder is hydrophilic by nature, a developer obtained by admixing siliceous fine powder agglomerates by absorbing moisture in the air to lower its flowability and is caused to lower its chargeability due to moisture absorption by the siliceous fine powder in severe cases. For this reason, the use of hydrophobicity-imparted silica fine powder has been proposed, e.g., by JP-A 46-5782, JP-A 48-47345 and JP-A 48-47346. More specifically, siliceous fine powder is reacted with a silane coupling agent to replace silanol groups on the surface of siliceous fine powder with another organic group for providing hydrophobicity. As the silane coupling agent, dimethyldichlorosilane, trimethylalkoxysilane, etc. have been used.

Further, it has been proposed to use siliceous fine powder with a hydrophobicity of 90% or higher obtained by treating siliceous fine powder with a silane coupling agent and then with silicone oil in an amount of D/25±D/30 wt. parts (D: specific surface area of the siliceous fine powder) in order to provide a sufficient hydrophobicity (e.g., JP-A 63-139367, JP-A 63-139369).

On the other hand, toners having finer particle sizes have been used in recent years so as to meet with diversification of function of image forming apparatus using electrophotography, such as copying machines and laser printers and to provide higher resolution and higher image quality. Correspondingly, it has become more difficult to effect uniform charging of the toners than before, so that it is desired to further increase the uniform chargeability of the toners.

SUMMARY OF THE INVENTION

A generic object of the present invention is to provide a magnetic toner and a magnetic developer having solved the above-mentioned problems.

A more specific object of the invention is to provide a magnetic toner capable of providing a high image density and excellent in image reproducibility.

Another object of the invention is to provide a magnetic toner having a stable chargeability and is free from causing fog even after long hours of use.

Another object of the invention is to provide a magnetic developer having a stable chargeability and is free from causing fog even after long hours of use.

Another object of the invention is to provide a magnetic developer not easily affected by remarkable changes in environmental conditions ranging from low temperature - low humidity to high temperature - high humidity.

Another object of the invention is to provide a magnetic developer capable of faithfully developing digital high-definition images to provide clear images of high density.

Another object of the invention is to provide a magnetic developer capable of providing clear and high-density images wherein image parts are tightly covered with a toner to provide sharp edges.

Another object of the invention is to provide a magnetic developer capable of providing a high image density with a small consumption.

Another object of the invention is to provide a magnetic developer excellent in powdery flowability and high-resolution characteristic.

A further object of the invention is to provide an apparatus unit, an image forming apparatus and a facsimile apparatus incorporating such a magnetic toner or magnetic developer.

According to the present invention, there is provided a magnetic toner, comprising a binder resin and a silicon-containing magnetic iron oxide;

wherein the magnetic iron oxide contains 0.5–4 wt. % silicon (based on total iron content), provided that the magnetic iron oxide has a total silicon content (A), a silicon content (B) dissolved together with the magnetic iron oxide when the magnetic iron oxide is dissolved up to 20 wt. % dissolution of iron, and a superficial silicon content (C), satisfying relations of $B/A\times100\%=$-44–84% and $C/A\times100\%=10$–55%; and the magnetic toner has a weight-average particle size of at most 13.5 ; μm and has a particle size distribution such that it contains no more than 50 wt. % of magnetic toner particles having a particle size of at least 12.7 μm.

The present invention also provides a magnetic developer, comprising the above-mentioned magnetic toner, and inorganic fine powder, hydrophobic inorganic fine powder or resin fine particles.

The present invention also provides an image forming apparatus, comprising:

a latent image-bearing member for bearing a latent image thereon and a developing apparatus for developing the latent image; the developing apparatus including a developer container for containing a developer, and a developer-carrying member for carrying and conveying the developer from the developer container to a developing zone facing the latent image-bearing member; wherein the developer comprises the above-mentioned magnetic toner.

The present invention further provides an apparatus unit, comprising:

a latent image-bearing member for bearing a latent image thereon and a developing apparatus for developing the latent image: the developing apparatus including a developer container for containing a developer, a developer-carrying member for carrying and conveying the developer from the developer container to a developing zone facing the latent image-bearing member, and a regulating blade for regulating the developer carried and conveyed by the developer-carrying member into a prescribed thickness to form a thin layer of the developer on the developer carrying member; wherein the developer comprises the above-mentioned magnetic toner.

The present invention further provides a facsimile apparatus, comprising:

an electrophotographic apparatus and a receiving means for receiving image data from a remote terminal;

wherein the electrophotographic apparatus comprises a latent image-bearing member for bearing a latent image thereon and a developing apparatus for developing the latent image; the developing apparatus including a developer container for containing a developer, a developer-carrying member for carrying and conveying the developer from the developer container to a developing zone facing the latent image-bearing member, and a regulating blade for regulating the developer carried and conveyed by the developer-carrying member into a prescribed thickness to form a thin layer of the developer on the developer carrying member; wherein the developer comprises the above-mentioned magnetic toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
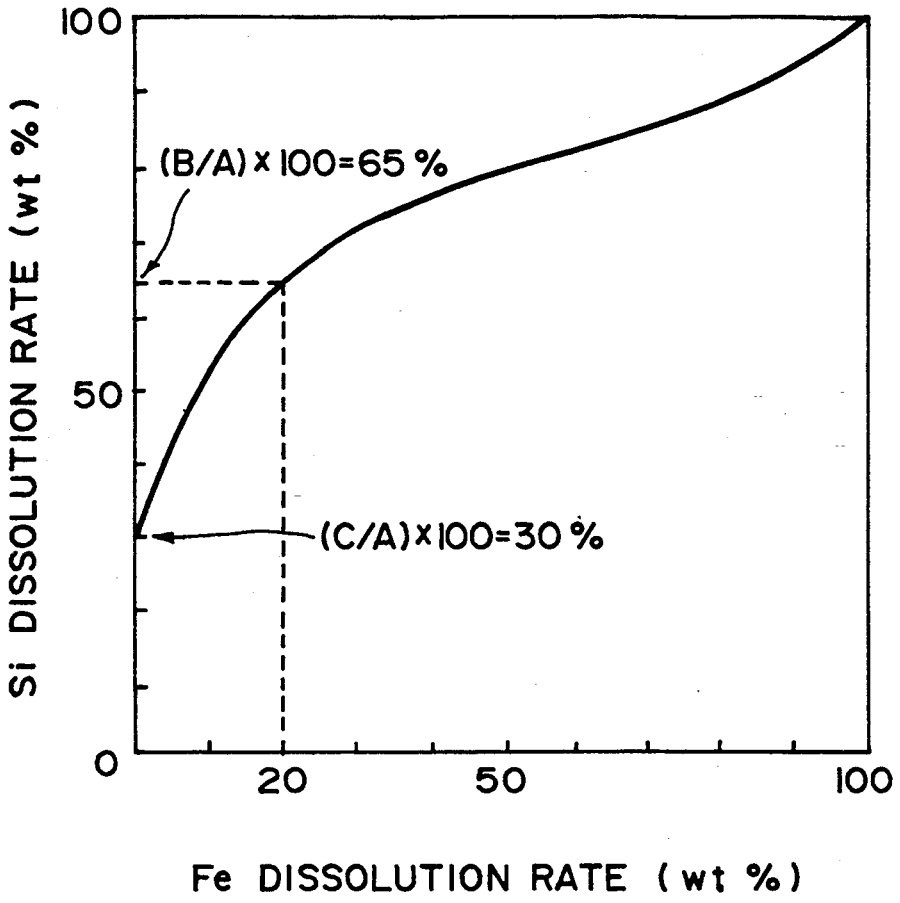
FIG. 1 shows a dissolution curve of magnetic iron oxide.

The reason why excellent performances can be attained by the magnetic toner and magnitude developer according to the present invention is not yet fully clear but may be assumed as follows.

A characteristic feature of the magnetic toner according to the present invention is that it has a weight-average particle size of at most 13.5 μm (preferably 3.5–13.5 μm), has a particle size distribution such that the magnetic toner particles having a particle size of at least 12.7 μm occupies at most 50 wt. %, and contains a specific silicon-containing magnetic iron oxide.

In case of a magnetic toner containing a large amount of relatively coarse particles, such as one having a weight-average particle size exceeding 13.5 μm or one containing more than 50 wt. % of magnetic toner particles having a particle size of at least 12.7 μm, it is possible to effect charge stabilization of the magnetic toner even by using a conventional magnetic iron oxide.

In case where magnetic toner particles having a weight-average particle size of below 3.5 μm, the flowability of the magnetic toner is lowered and problems, such as fog or insufficient density, due to insufficient charge, are liable to be caused, even if the specific magnetic iron oxide according to the invention is used. Therefore, the weight-average particle size should preferably be at least 3.5 μm.

Remarkably improved effects, such as improvements in charging stability and flowability, of the magnetic toner are attained compared with the conventional magnetic toner in the case where the weight-average particle size is at most 13.5 μm (preferably 3.5–13.5 μm, more preferably 5.0–13.0 μm), and the content of the magnetic toner particles of at least 12.7 μm is at most 50 wt. %, preferably at most 40 wt. %.

Another characteristic feature of the magnetic toner according to the present invention is that the magnetic iron oxide therein contains silicon (Si) at a content of 0.5–4.0 wt. % (preferably 0.8–3.0 wt. %, further preferably 0.9–3.0 wt. %) based on the total iron (Fe) content therein. If the silicon content is below 0.5 wt. %, the improving effect (particularly in respect of flowability) for the magnetic toner is insufficient. If the silicon content exceeds 4.0 wt. %, the siliceous component is liable to be present on the surface of the magnetic iron oxide or adversely affect the magnetic properties.

Another characteristic feature of the magnetic toner according to the present invention is that the magnetic iron oxide contained therein has a total silicon content (A), a silicon content (B) dissolved together with the magnetic iron oxide when the magnetic iron oxide is dissolved up to 20 wt. % dissolution of iron, and a superficial silicon content (C), satisfying-relations of $B/A \times 100\% = 44–84\%$ (preferably 60–80%) and $C/A \times 100\% = 10–55\%$ (preferably 25–40%).

If the B/A ratio is below 44%, the silicon is excessively present in the core part of a magnetic iron oxide particle. This is liable to result in a poor production efficiency and a magnetic iron oxide having unstable magnetic properties.

If the B/A ratio exceeds 84%, excessive silicon is present in a layer in the superficial part of magnetic iron oxide particles, so that the surface of the magnetic iron oxide becomes fragile against mechanical shock to be liable to result in many adverse effects to the magnetic toner.

If the C/A ratio is below 10%, the silicon is present little on the magnetic iron oxide surface. As a result, it becomes difficult to provide the magnetic iron oxide and magnetic toner with good flowability and moreover the charge and volume resistivity of the magnetic iron oxide are liable to be lowered to impair the charge stability and environmental stability the magnetic toner.

If the C/A ratio exceeds 55%, noticeable unevenness results on the magnetic iron oxide surface and is liable to form fragments to be dispersed among the magnetic toner particles during production of the magnetic toner, thus giving adverse effects to the magnetic toner performances.

In order to provide good magnetic toner properties, it is preferred that the silicon is distributed so that the silicon content increases continuously or stepwise from the core to the surface of a magnetic iron oxide particles.

In the present invention, it is further preferred that the magnetic iron oxide has a chargeability of −25 to −70 μC/g, particularly −40 to −60 μC/g, and a volume resistivity of $5 \times 10^3$ to $1 \times 10^8$ Ω.cm, particularly $5 \times 10^4$ to $5 \times 10^7$ Ω.cm.

If the chargeability of magnetic iron oxide is less than −25 μC/g, the magnetic toner cannot retain a required charge on repetitive long-term use of the magnetic toner which results in lower image density, occurrence of fog, etc. On the other hand, if the chargeability of the magnetic iron oxide exceeds −70 μC/g, the magnetic toner is liable to be provided with an excessive chargeability which results in lower image density in a low temperature - low humidity environment.

If the magnetic iron oxide has a volume resistivity of below $5 \times 10^3$ Ω.cm, it is liable that the magnetic toner cannot retain a required charge to result in lower image density. On the other hand, if the volume resistivity exceeds $1 \times 10^8$ Ω.cm, an excessively high charge is liable to result on repetitive use in a low temperature - low humidity environment to result in lower image density.

In the present invention, it is further preferred that the magnetic iron oxide has an agglomeration degree of 3–40%, particularly 5–30%.

If the magnetic iron oxide has an agglomeration degree of below 3%, so-called "flushing" or blowing-out of magnetic toner is liable to occur during the production of the magnetic toner, so that effective production of the magnetic toner becomes difficult.

On the other hand, if the agglomeration degree exceeds 40%, it is not easy to disperse the magnetic iron oxide in the magnetic toner, thus it is liable to adversely affect to the image density and fog. In the present invention, the flowability of the magnetic iron oxide is reflected in that of the magnetic toner. Accordingly, if a magnetic iron oxide having an agglomeration degree in excess of 40% is used, it is difficult to obtain a magnetic toner having a sufficient flowability, thus tending to adversely affect the chargeability of the magnetic toner and cause fog, etc.

In the present invention, it is further preferred that the magnetic iron oxide has a smoothness D of 0.2–0.6, particularly 0.3–0.5.

If the smoothness D is below 0.2, the unevenness on the magnetic iron oxide surface is noticeable and liable to result in fragments during the magnetic toner production, which are dispersed in the magnetic toner to adversely affect the toner properties.

On the other hand, if the smoothness exceeds 0.6, it is difficult to obtain a sufficient adhesion between the magnetic iron oxide and a binder resin constituting the magnetic toner, so that the magnetic iron oxide present at the magnetic toner surface is gradually separated on repetitive use to cause an adverse effect, such as a decrease in image density.

In the present invention, it is further preferred that the magnetic iron oxide has a sphericity $\phi$ of at least 0.8. If the sphericity is below 0.8, magnetic iron oxide particles are caused to each other face to face, so that small magnetic iron oxide particles of about 0.1–1.0 μm cannot be easily separated from each other even under application of mechanical shearing force and sufficient dispersion of magnetic iron oxide within the magnetic toner cannot be effected in some cases.

In the present invention, it is further preferred that the magnetic iron oxide has an average particle size of 0.1–0.4 μm, particularly 0.1–0.3 μm.

Various physical parameters characterizing the present invention may be measured according to the following methods.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 μm-aperture to obtain a volume-basis distribution and a number-basis distribution. From the results of the volume-basis distribution and number-basis distribution, parameters characterizing the magnetic toner of the present invention may be obtained. More specifically, the weight-basis average particle size $D_4$ may be obtained from the volume-basis distribution while a central value in each channel is taken as a representative value for each channel. Similarly, the weight percentage of particles having a particle size of 12.7 μm is obtained from the volume-basis distribution.

The superficial silicon content (C) of magnetic iron oxide may be measured in the following manner. For example, about 3 liter of deionized water is placed in a 5 liter-beaker and warmed at 50°–60° C. on a water bath. About 25 g of magnetic iron oxide is dispersed in about 400 ml of deionized water to form a slurry, which slurry was then charged into the 5 liter-beaker while being washed with about 300 ml of deionized water.

Then, while the slurry containing the magnetic iron oxide at a rate of about 5 g/l is maintained at about 60° C. under stirring at 200 rpm, reagent-grade sodium hydroxide is added thereto to form an about 1-normal aqueous sodium hydroxide solution, thus starting the dissolution of the superficial silicon in the form of a silicon compound such as silicic acid on the magnetic iron oxide particle surface. At 30 min. after the start of dissolution, 20 ml of the sodium hydroxide solution is sampled and filtered through a 0.1 μm-membrane filter to recover the filtrate, which is then subjected to the inductively coupled plasma analysis (ICP) to determine the silicon content.

The superficial silicon content (C) is measured by dividing the silicon concentration (mg/l) by the magnetic iron oxide concentration (about 5 g/l) respectively in the sodium hydroxide aqueous solution.

The total silicon content (based on total iron content), iron (Fe) dissolution rate and silicon (Si) contents A and B corresponding to the Fe dissolution may be measured in the following manner. For example, about 3 liter of deionized water is placed in a 5 liter-beaker and warmed at 50°–60° C. on a water bath. A slurry of about 25 g of magnetic iron oxide in about 400 ml of deionized water is added to the 5-liter beaker while washing it with about 300 ml of deionized water.

Then, the system is held at about 50° C. under stirring at about 200 rpm, reagent-grade hydrochloric acid or a mixture of hydrochloric acid and hydrofluoric acid is added to the system to start the dissolution. In the case of hydrochloric acid addition, for example, the magnetic iron oxide concentration is about 5 g/l and the hydrochloric acid concentration is about 3 normal at this time. From the start of the dissolution until the complete dissolution to provide a clear solution, an about 20 ml-sample is taken from the system for each 10 minutes and filtered through a 0.1 μm-membrane filter to recover a filtrate, which is then subjected to the ICP analysis to determine the iron (as Fe) content and silicon (as Si) content.

For each sample, the iron dissolution rate may be calculated as follows.

Iron (Fe) dissolution rate = [iron concentration in a sample (mg/l)/iron concentration in complete dissolution (mg/l))] × 100

For each sample, the silicon content may be calculated as follows.

Silicon (Si) content = [silicon concentration (mg/l)/iron concentration (mg/l)] × 100.

The total silicon content (based on total iron) may be measured similarly with respect to the sample after the complete dissolution.

The total silicon content (A) per unit weight of magnetic iron oxide may be obtained by dividing the silicon concentration (mg/l) in a sample after the complete dissolution by the magnetic iron oxide concentration in the sample (about 5 g/l).

The silicon content (B) may be obtained by dividing the silicon concentration (mg/l) in a sample at 20% iron (Fe) dissolution by the magnetic iron oxide concentration in the sample.

The contents A, B and C may be measured in different manners, e.g., as follows:

(1) A sample magnetic iron oxide is divided into two portions, one for measurement of the total silicon content and the contents A and B, and the other for measurement of the content C.

(2) A sample magnetic iron oxide is first used for measurement of the content C, and the sample after the measurement is used for measurement of content B' (=B-C) and content A' (=A-C), then finally calculating the contents A and B.

The chargeability (μC/g) of magnetic iron oxide may be measured as follows.

About 2 g of magnetic iron oxide and about 198 g of carrier iron powder ("TEFV 200–300 mesh", mfd. by Nihon Teppun K.K.) are taken in a plastic bottle, mixed by shaking for 10 seconds by hands and then vibrated in a V-shaped blender, followed by measurement of the charge by a blow off-type powder charge meter (mfd. by Toshiba Chemical K.K.). In this instance, a 400-mesh net of stainless steel is set at the Faraday cage for measurement with respect to about 0.4 g of sample after 30 sec. of blowing-off.

The volume resistivity of magnetic iron oxide may be measured as follows.

10 g of magnetic iron oxide is placed in a measurement cell and molded under a pressure of 600 kg/cm$^2$ by means of an oil-pressure cylinder. After the pressure is released, a resistance meter ("YEW MODEL 2506A DIGITAL MULTIMETER", mfd. by Yokogawa Denki K.K.) is set, and then a pressure of 150 kg/cm$^2$ is applied again by means of an oil-pressure cylinder. At 3 min. after the initiation of the measurement, the resistance value is read. Then, the sample thickness is measured, and a volume resistivity value is calculated from the measured data.

The agglomeration degree of magnetic iron oxide may be measured as follows.

10 g of magnetic iron oxide is pulverized by a mixer and caused to pass through a 200-mesh sieve to take a sample of 2 g. In a powder tester (mfd. by Hosokawa Micron K.K.), three sieves of 60 mesh, 100 mesh and 200 mesh are superposed and set. Then, the sample of 2 g is placed gently on the uppermost sieve, and the sieves are vibrated for 65 sec. at an amplitude of 1 mm. The sample weights on the respective sieves are measured and the agglomeration degree is calculated according to the following formula:

Agglomeration degree (%) = {[(sample weight on 60 mesh-sieve) × 1.0 + (sample weight on 100 mesh-sieve) × 3/5 + (sample weight on 200 mesh-sieve) × 1/5]/(original sample weight placed on the sieves)} × 100.

The smoothness D of magnetic iron oxide may be defined as follows:

Smoothness $D$ = [Surface area (m$^2$/g) of magnetic iron oxide calculated from the average particle size]/[Measured BET surface area (m$^2$/g) of magnetic iron oxide].

The BET surface area of magnetic iron oxide may be measured by using an all-automatic gas absorption tester ("Autosorb 1", mfd. by Yuasa Ionix K.K.) and nitrogen as an absorption gas according to the BET multipoints method. The sample is subjected to evacuation for 1 hour at 50° C. as a pre-treatment.

The measurement of average particle size (diameter) and calculation of surface area of magnetic iron oxide may be performed as follows.

A sample magnetic iron oxide is treated on a collodion-filmed copper mesh and photographed through an electron microscope ("H-700H", mfd. by Hitachi Seisakusho K.K.) at an acceleration voltage of 100 KV and a magnification of 10,000, followed by printing at 3 times to provide picture at a final magnification of 30,000. On the picture, the particle shape is observed, and the maximum length (μm) of each particle is taken with respect to 100 particles selected at random. An average particle size is determined by averaging the maximum lengths.

The surface area is calculated based on the assumption that each particle assumes a sphere having a diameter of the average particle size to calculate the surface are and volume of each sphere. The density of the magnetic iron oxide is measured in an ordinary method. The weight of each sphere is calculated from the volume and density. From these values, the surface area based on the average particle size is calculated.

The sphericity of magnetic iron oxide is defined as follows.

Sphericity $\phi$ = [minimum length (μm) of magnetic iron oxide particle]/[maximum length (μm) of the particle].

The sphericity is calculated as an average based on 100 magnetic iron oxide particles selected at random from the picture described above for measuring the average particle size.

Ordinary magnetic iron oxide of a cubic crystal form has a sphericity $\phi$ of about 0.6–0.7, i.e., below 0.8, but the magnetic iron oxide preferably used in the present invention has a sphericity $\phi$ of at least 0.8, preferably at least 0.85, further preferably at least 0.9, and has a shape which is free from angle or edge and is close to a sphere.

A magnetic iron oxide having a sphericity of below 0.8 tends to be inferior in dispersibility in the binder resin even if the silicon is localized at the magnetic iron oxide particle surface, thus being liable to provide a magnetic toner having a lower developing performance in respect of, e.g., dot reproducibility.

The magnetic toner according to the present invention may preferably contain the magnetic iron oxide in an amount of 20–200 wt. parts, further preferably 30–150 wt. parts, per 100 wt. parts of the binder resin.

The magnetic toner according to the present invention may preferably have a particle size distribution such that the magnetic toner has a weight-average particle size of 6–8 μm and contains 17–60% by number of toner particles of 5 μm or smaller, 5–50% by number of toner particles of 6.35 10.08 μm and at most 2.0% by volume of toner particles of 12.7 μm or larger, and the contents of the magnetic toner particles of 5 μm or smaller in terms of % by number (N %) and % by volume (V %) satisfy the relationship of $N/V = -0.05N + k$, wherein k is a positive number of from 4.6 to 6.7, and N is a positive number of from 17 to 60.

Hitherto, it has been considered necessary to decrease magnetic toner particles of 5 μm or smaller because they provide a difficulty in charge control, impair the flowability of the magnetic toner, cause toner scattering to soil the apparatus and cause fog in the resultant image.

As a result of our study, however, it has been found that magnetic toner particles of 5 μm or smaller constitute an essential component for providing images of a high quality.

As a test for evaluating the developing characteristic of a magnetic toner, a magnetic toner having a particle size distribution ranging from 0.5 μm to 30 μm was used for developing latent images on a photosensitive member having various surface potential contrasts ranging from a large potential contrast at which a majority of toner particles were readily used for development, through a half tone contrast, and to a small potential contrast at which slight portions of toner particles were used for development. Then, the toner particles used for developing the latent images were recovered from the photosensitive member for measurement of the particle size distribution. As a result, it was found that the proportion of magnetic toner particles of 8 μm or smaller, particularly magnetic toner particles of 5 μm or smaller, was increased. It was also found that latent images were faithfully developed without enlargement and at a good reproducibility when magnetic toner particles of 5 μm or smaller most suitable for development were smoothly supplied to latent images on the photosensitive member. This phenomenon was similarly observed also in the case of reverse development of digital latent images.

Another characteristic of the magnetic toner used in the present invention is that toner particles of 6.35–10.08 μm constitute 5–50% by number. This is related with the above-mentioned necessity of the magnetic toner particles of 5 μm or smaller. Magnetic toner particles of 5 μm or smaller are able to strictly cover and faithfully reproduce a latent image, but a latent image per se has a higher electric field intensity at the peripheral edge than the middle or central portion. As a result, toner particles are attached to the central portion in a smaller thickness than to the peripheral part, so that the inner part is liable to be thin in density. This tendency is particularly observed by magnetic toner particles of 5 μm or smaller. We have found that this problem can be solved to provide a clear image by using toner particles of 6.35–10.08 μm in a proportion of 5–50 by number. This may be attributable to a fact that magnetic toner particles of 6.35–10.08 μm are supplied to an inner part having a smaller intensity than the edge of a latent image presumably because they have a moderately controlled charge relative to magnetic toner particles of 5 μm or smaller, thereby to compensate for the less coverage of toner particles and result in a uniform developed image. As a result, a sharp image having a high density and excellent in resolution and gradation characteristic can be attained.

Figure 9:
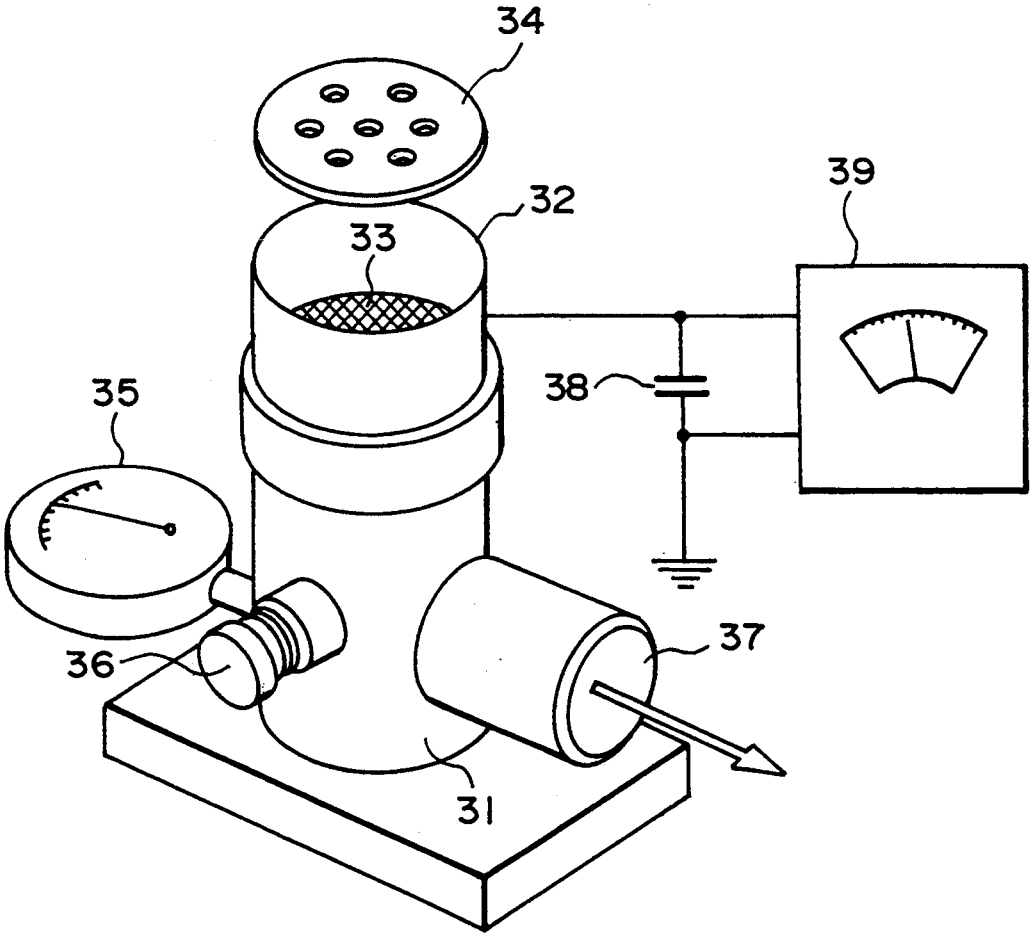
FIG. 9 is an illustration of an instrument for measuring triboelectric charge.

It is preferred that the contents of the toner particles of 5 μm or smaller in terms of % by number (N %) and % by volume (V %) satisfy the relationship of $N/V=-0.05N+k$, wherein $4.6 \leqq k \leqq 6.7$, and $17 \leqq N \leqq 60$. FIG. 9 indicates the range defined by the relationship, and the magnetic toner having a particle size distribution satisfying the relationship in addition to the other features according to the present invention accomplishes a better developing performance with respect to highly fine latent images.

We have found a certain state of presence of fine powder accomplishing the intended performance satisfying the above formula during our study on the particle size distribution with respect to particles of 5 μm or smaller. With respect to a certain value of N, a large N/V value is understood to mean that a large proportion of particles smaller than 5 μm are present with a broad particle size distribution, and a small N/V value is understood to mean that particles having a particle size in the neighborhood of 5 μm is present in a large proportion and particles smaller than that are present in a small proportion. Within the range of 17–60 for N, a further better thin-line reproducibility and high resolution are accomplished when the N/V is in the range of 1.6–5.85 and further satisfy the above formula relationship.

Magnetic toner particles of 12.7 μm or larger is suppressed to be not more than 2.0% by volume. The fewer, the better.

The magnetic developer according to the present invention has solved the problems of the prior art and can satisfy high image quality severely required in recent years.

The particle size distribution of the magnetic toner used in the present invention is described more specifically below.

Magnetic toner particles of 5 μm or smaller may be contained in a proportion of 17–60% by number, preferably 25–60% by number, further preferably 30–60% by number, of the total number of particles. If the content of the magnetic toner particles of 5 μm or smaller is below 17% by number, a portion of the magnetic toner particles effective for providing a high image quality is small and particularly, as the toner is consumed during a continuation of copying or printing-out, the effective component is preferentially consumed to result in an awkward particle size distribution of the magnetic toner and gradually deteriorates the image quality. If the content is above 60% by number, mutual agglomeration of the magnetic toner particles is liable to occur to produce toner lumps having a larger size than the proper size, thus leading to difficulties, such as rough image quality, a low resolution, a large difference in density between the contour and interior of an image to provide a somewhat hollow image.

It is preferred that the content of the particles in the range of 6.35–10.08 μm is 5–50% by number, further preferably 8–40% by number. Above 50% by number, the image quality becomes worse the thin-line reproducibility is lowered, and excess of toner coverage is liable to occur, thus resulting in an increased toner consumption. Below 1% by number, it becomes difficult to obtain a high image density in some cases. The contents of the magnetic toner particles of 5 μm or smaller in terms of % by number (N %) and % by volume (V %) may preferably satisfy the relationship of $N/V=-0.05N+k$, wherein k represents a positive number satisfying $4.6 \leqq k \leqq 6.7$, preferably $4.6 \leqq k \leqq 6.2$, further preferably $4.6 \leqq k \leqq 5.7$, and N is a number satisfying $17 \leqq N \leqq 60$, preferably $25 \leqq N \leqq 60$, further preferably $30 \leqq N \leqq 60$.

If $k<4.6$, magnetic toner particles of 5.0 μm or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image free of coarsening. Particularly, these particles fill thinline portions and contour portions of an image, thereby to visually improve the sharpness thereof. If $k<4.6$ in the above formula, such component becomes insufficient in the particle size distribution, and the above-mentioned characteristics become poor.

Further, in view of the production process, a large amount of fine powder must be removed by classification in order to satisfy the condition of $k<4.6$. Such a process is however disadvantageous in yield and toner costs. On the other hand, if $k>6.7$, an excess of fine powder is present, whereby the image density tends to be lowered on continuation of copying or print-out. It is considered that such lowering in image density may be caused by a phenomenon that excess of fine powdery magnetic toner particles having an unnecessarily high charge adhere to the developing sleeve, whereby normal magnetic toner particles are hindered from being carried on the developing sleeve and imparted with charge.

In the magnetic toner of the present invention, the amount of magnetic toner particles having a particle size of 12.7 μm or larger is 2.0% by volume or smaller, preferably 1.0% by volume or smaller, more preferably 0.5% by volume or smaller. If the above amount is larger than 2.0% by volume, these particles are liable to impair thin-line reproducibility.

The magnetic toner used in the present invention may have a weight-average particle size of 6–8 μm. This value cannot be considered separately from the above-mentioned factors. If the weight-average particle size is below 6 μm, a problem of insufficient toner coverage on a transfer paper is liable to be caused for a digital latent image having a high image area proportion, such as a graphic image. This is considered to be caused by the same reason as the problem that the interior of a latent image is developed at a lower density than the contour. If the weight-average particle size exceeds 8 μm, a good resolution may not be obtained for fine spots of 100 μm or smaller and much scattering to the non-image part is encountered. Further, the image quality is liable to be lowered on continuation of copying even if it is satisfactory at the initial stage of copying.

The magnetic iron oxide used in the magnetic toner according to the present invention can be treated with silane coupling agent, titanate coupling agent, aminosilane, etc., as desired.

Examples of the binder resin constituting the toner according to the present invention may include: homopolymers of styrene and its derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resin, aromatic petroleum resin, paraffin wax, and carnauba wax. These resins may be used alone or in mixture. Particularly, styrene copolymers and polyester resins may be preferred in view of developing and fixing performances.

In the toner according to the present invention, it is also possible to use hydrocarbon wax or ethylenic olefin polymers, as a fixing aid, in combination with the binder resin.

Examples of such ethylenic olefin homopolymers or copolymers may include: polyethylene, polypropylene, ethylene-propylene copolymer, ethylene-vinyl acetate copolymer, ethylene-ethyl acrylate copolymer, and ionomers having polyethylene skeletons. Among the copolymers, those including olefin monomer in proportion of at least 50 mol. %, particularly at least 60 mol. %, may be preferred.

The magnetic toner according to the present invention can further contain a colorant, examples of which may include known pigments or dyes, such as carbon black and copper-phthalocyanine.

The magnetic toner according to the present invention can contain a charge control agent. For a negatively chargeable toner, it is possible to use a negative charge control agent, such as metal complex salts of monoazo dyes, and metal complex salts of salicylic acid, alkylsalicylic acid, dialkylsalicylic acid or naphthoic acid.

Further, for a positively chargeable toner, it is possible to use a positive charge control agent, such as nigrosine compounds and organic quaternary ammonium salts.

The magnetic toner according to the present invention may preferably be mixed with inorganic fine powder or hydrophobic inorganic fine powder, e.g., silica fine powder.

The fine silica powder used in the present invention can be either the so-called "dry process silica" or "fumed silica" which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue.

It is preferred that the silica fine powder has been subjected to a hydrophObicity-imparting treatment. For the hydrophobicity-imparting treatment, the silica fine powder may be chemically treated with, e.g., an organic silicon compound which reacts with or is physically adsorbed by the silica fine powder. A preferred method includes steps of treating dry-process silica fine powder produced by vapor-phase oxidation of silicon halide with a silane coupling agent and, simultaneously therewith or thereafter, treating the silica fine powder with an organic silicon compound, such as silicone oil.

Examples of the silane coupling agent used for the hydrophobicity-imparting treatment may include: hexamethyldisilazane, trimethylsilane, trimethylchlorosilane, trimethylethoxysilane, dimethyldichlorisilane, methyltrichlorosilane, allyldimethylchlorosilane, allylphenyldichlorosilane, benzyldimethylchlorosilane, bromomethyldimethyl-chlorosilane, α-chloroethyltrichlorosilane, β-chloro-ethyltrichlorosilane, chloromethyldimethylchloro-silane, triorganosilanemercaptan, trimethylsilylmercaptan, triorganosilyl acrylate, vinyldimethyl-acetoxysilane, dimethylethoxysilane, dimethyldimethoxysilane, diphenyldiethoxysilane, hexamethyldisiloxane, 1,3-divinyltetramethyl-disiloxane, and 1,3-diphenyltetramethyldisiloxane.

The organic silicon compound may for example be silicone oil. The silicone oil may preferably have a viscosity at 25 ° C. of about 30–1,000 centi-stokes and may preferably include, for example, dimethyl-silicone oil, methylphenylsilicone oil, α-methyl-styrene-modified silicone oil, chlorophenylsilicone oil, and fluorinated silicone oil.

The treatment with silicone oil may be performed, e.g., by directly mixing the silica fine powder treated with silane coupling agent with silicone oil by a mixer such as a Henschel mixer, by spraying silicone oil onto the silica fine powder, or by mixing a solution or dispersion of silicone oil in an appropriate solvent with the silica fine powder, followed by removal of the solvent.

In the present invention, it is preferred that an inorganic fine powder for providing a magnetic developer has been treated with silicone or silicone varnish so as to provide an attached carbon amount of 3–8 wt. %.

Alternatively, it is preferred in the present invention that an inorganic fine powder for providing a magnetic developer has been treated with silicone oil or silicone varnish so as to cause a reduction in specific surface area of the inorganic fine powder to 0.4–0.6 times the value before the treatment.

By the treatment with silicone oil or varnish, the fine powder surface is covered by the oil or varnish to provide a remarkably improved moisture resistance.

In a preferred embodiment of the present invention, the fine powder is treated with highly negatively chargeable silicone oil or varnish, so that the fine powder is provided with a strong negative chargeability to result in a developer which is also provided with a strong negative chargeability. This is effective for a magnetic one-component type developer which is liable to be provided with an unstable charge. This is particularly effective when combined with a magnetic toner which has been reduced in size for providing a higher image quality.

The fine powder may comprise an inorganic substance, preferred examples of which may include: fine powder of oxides of metals of the third or fourth group, such as silica or siliceous material, alumina, and titanium oxide. A preferred example of the fine powder may include silica fine powder, which can be either the so-called "dry process silica" or "fumed silica" which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue such as $Na_2O$, $SO_3^{2-}$. The dry process silica referred to herein can include a complex fine powder of silica and another metal oxide as obtained by using another metal halide, such as aluminum chloride or titanium chloride together with a silicon halide. The silica powder may preferably have an average primary particle size in the range of 0.001–2 μm, particularly 0.002–0.2 μm.

The solid or resinous content in the silicone oil or silicone varnish may be represented by the following formula:

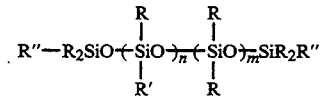

wherein R: a $C_1$–$C_3$ alkyl group, R′: a silicone oil-modifying group, such as alkyl, halogen-modified alkyl, phenyl, and modified-phenyl, R″: a $C_1$–$C_3$ alkyl or alkoxy group.

Specific examples thereof may include: dimethylsilicone oil, alkyl-modified silicone oil, α-methylstyrene-modified silicone oil, chlorophenylsilicone oil, and fluoro-modified silicone oil. The above silicone oil may preferably have a viscosity at 25 ° C. of about 50–1000 centi-stokes. A silicone oil having too low a molecular weight can generate a volatile matter under heating, while one having too high a molecular weight has too high a viscosity leading to a difficulty in handling.

In order to treat the silica fine powder with silicone oil, there may be used a method wherein silica fine powder treated with a silane coupling agent is directly mixed with a silicone oil by means of a mixer such as Henschel mixer or a method wherein a silicone oil is sprayed on silica as a base material. It is further preferred to use a method wherein a silicone oil is dissolved or dispersed in an appropriate solvent, the resultant liquid is mixed with silica as a base material, and then the solvent is removed to form a hydrophobic silica.

It is preferred that the silica fine powder has been treated with silicone oil or varnish so as to provide an attached carbon amount of 3–8 wt. % based on the silica fine powder. Herein, the attached carbon amount may be measured by an elemental analyzer (CHN meter).

Alternatively, it is preferred that the treatment with silicone oil or varnish is performed in such a degree as to reduce the specific surface area of the silica fine powder to 0.4–0.6 times the value before the treatment. Herein, the specific surface area of silica fine powder may be measured by the BET method using $N_2$-adsorption. Such control of the degree of treatment is based on the following reasons. If the decrease in specific surface area is small, this means that the treatment with silicone oil or varnish is insufficient or ununiform. As a result, in the former case a sufficient improvement in moisture resistance is not attained moisture absorption by the silica fine powder occurs thus failing to provide a high quality image, under a high-humidity condition. In the latter case, a negative chargeability is not imparted uniformly as a result of the treatment with silicone oil or varnish, so that the uniform chargeability of the developer is insufficient. A difficulty occurs in that the amount of the toner remaining on the photosensitive member after the transfer step which is removed to be recovered cannot thereafter be decreased particularly in the case where a smaller size toner is used. On the other hand, if the decrease in specific surface area of the silica fine powder by the treatment with silicone oil or varnish, the silica fine powder is liable to agglomerate, this failing to provide the developer with an improved flowability.

The solid or resinous content in the silicone oil or varnish used for the treatment may generally be 3–50 wt. parts per 100 wt. parts of the silica fine powder.

It is further preferred to treat the silica fine powder first with a silane coupling agent and then with silicone oil or silicone varnish.

When the inorganic fine powder is treated only with silicone oil or varnish, a large amount of silicone oil is required in order to cover the surface of the silica fine powder, so that the silica fine powder can agglomerate to provide a developer with a poor fluidity and the treatment with silicone oil or varnish must be carefully performed. However, if the silica fine powder is first treated with a silane coupling agent and then with a silicone oil, the fine powder is provided with a good moisture resistance while preventing agglomeration of the powder and thus the treatment effect with silicone oil or varnish can be sufficiently exhibited.

The silane coupling agent used in the present invention may be hexamethyldisilazane or those represented by the formula: $R_mSiY_n$, wherein R: an alkoxy group or chlorine atom, m: an integer of 1–3, Y: alkyl group, vinyl group, glycidoxy group, methacryl group or other hydrocarbon groups, and n: an integer of 3–1. Specific examples thereof may include: dimethyldichlorosilane, trimethylchlorosilane, allyldimethylchlorosilane, allylphenyldichlorosilane, benzyldimethylchlorosilane, vinyltriethoxysilane, γ-methaceryloxypropyltrimethoxysilane, vinyltriacetoxysilane, divinylchlorosilane, and dimethylvinylchlorosilane.

The treatment of the fine powder with a silane coupling agent may be performed in a dry process wherein the fine powder is agitated to form a cloud with which a vaporized or sprayed silane coupling agent is reacted, or in a wet process wherein the fine powder is dispersed in a solvent into which a silane coupling agent is added dropwise to be reacted with the fine powder.

The thus treated silica fine powder may be used in an amount of 0.01–20 wt. parts, preferably 0.1–3 wt. parts, per 100 wt. parts of the magnetic toner.

An external additive other than the silica fine powder may be added, as desired, to the magnetic toner according to the present invention.

For example, it is preferred to externally add resin fine particles having an average particle size of 0.03–2.0 μm and a chargeability to the same polarity as the magnetic toner to the magnetic toner.

The particle size of such resin fine particles may be measured in various manners, but the values referred to herein are based on values measured in the following manner. Such resin particles are photographed at a magnification of 10,000 –20,000 through an electron microscope ("S-800", mfd. by Hitachi Seisakusho K.K.), and 100–200 particles selected at random from the photographed resin particles are measured with respect to their diameter by using a caliper, whereby the measured diameters are averaged to provide an average particle size of the resin particles.

The triboelectric chargeability of such resin fine powder may be measured in the following manner.

0.2 g of resin fine powder which have been left to stand overnight in an environment of 23.5° C. and relative humidity of 60% RH, and 9.8 g of carrier iron powder not coated with a resin having a mode particle size of 200 to 300 mesh (e.g. EFV 200/300, produced by Nippon Teppun K.K.) are mixed thoroughly in a 50 cc wide-mouthed polyethylene bottle having a cap in the same environment as mentioned above (by shaking the pot in hands vertically about 125 times for about 50 sec).

Figure 3:
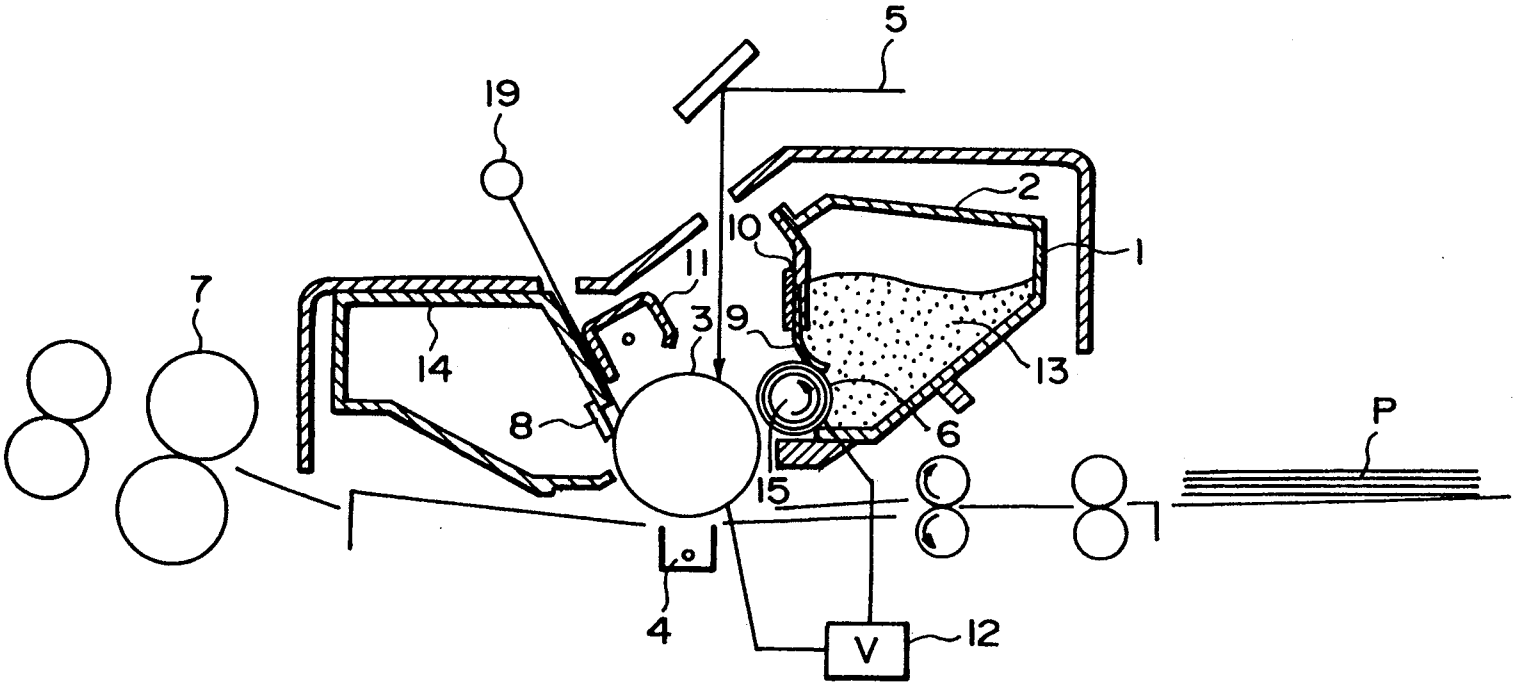
FIG. 3 is a schematic illustration of an embodiment of the image forming apparatus (provided with an elastic blade) according to the invention.

Then, about 0.5 g of the shaken mixture is charged in a metal container 32 for measurement provided with 400-mesh screen 33 at the bottom as shown in FIG. 3 and covered with a metal lid 34. The total weight of the container 32 is weighed and denoted by $W_1$ (g). Then, an aspirator 31 composed of an insulating material at least with respect to a part contacting the container 32 is operated, and the silica in the container is removed by suction through a suction port 37 sufficiently while controlling the pressure at a vacuum gauge 35 at 250 mmHg by adjusting an aspiration control valve 36. The reading at this time of a potential meter 39 connected to the container by the medium of a capacitor having a capacitance C (μF) is denoted by V (volts.). The total weight of the container after the aspiration is measured and denoted by $W_2$ (g). Then, the triboelectric charge (μC/g) of the silica is calculated as: $CxV/(W_1-W_2)$.

The resin fine particles used for together with the magnetic toner according to the present invention may be prepared by soap-free polymerization or emulsion polymerization. Good effects may be exhibited by resin fine particles prepared by one, or two or more of monomers, preferred examples of which may include: styrene, acrylic acid, methyl methacrylate, butyl acrylate, and 2-ethylhexyl acrylate.

The resin fine particles can be crosslinked with, e.g., divinylbenzene and can be surface-treated with a metal, a metal oxide, a pigment or dye or a surfactant, as a preferred mode.

Further, it is also possible to internally or externally add to the magnetic toner according to the present invention other additives, such as a charge-supplementing agent, an electroconductivity-imparting agent, a flowability-imparting agent, a release agent added to heat-fixing, and resin fine particles or inorganic fine particles functioning as lubricants or abrasives.

It is preferred to use the inorganic fine powder or hydrophobic inorganic fine powder to be mixed with the magnetic toner in an amount of 0.1–5 wt. parts, more preferably 0.1–3 wt. parts, per 100 wt. parts of the magnetic toner.

The magnetic toner for developing electrostatic images according to the present invention may be produced by sufficiently mixing the magnetic iron oxide powder with a binder resin, such as a vinyl-type thermoplastic resin or a polyester resin, like those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the magnetic iron oxide powder or the pigment or dye, and optional additives, if any, in the melted resin; cooling and pulverizing the mixture; and subjecting the powder product to precise classification to form the magnetic toner according to the present invention.

Description will be made about the image forming apparatus, the apparatus unit and the facsimile apparatus using the magnetic toner or magnetic developer according to the present invention.

A preferred embodiment of the image forming apparatus is described with reference to FIG. 3.

An OPC photosensitive member 3 surface is negatively charged by a primary charger 11, subjected to image-scanning with laser light 5 to form a digital latent image, and the resultant latent image is reversely developed with a monocomponent magnetic developer 13 comprising a magnetic toner in a developing apparatus 1 which comprises a developing sleeve 6 equipped with an elastic blade 9 of urethane rubber disposed counterwise and enclosing a magnet 5. In the developing zone, an alternating bias, pulse bias and/or DC bias is applied between the conductive substrate of the photosensitive drum 5 and the developing sleeve 6 by a bias voltage application means 12. When a transfer paper P is conveyed to a transfer zone, the paper is charged from the back side (opposite side with respect to the photosensitive drum) by an electrostatic transfer means 4, whereby the developed image (toner image) on the photosensitive drum is electrostatically transferred to the transfer paper P. Then, the transfer paper P is separated from the photosensitive drum 3 and subjected to fixation by means of a hot pressing roller fixer 7 for fixing the toner image on the transfer paper P.

Residual monocomponent developer remaining on the photosensitive drum after the transfer step is removed by a cleaner 14 having a cleaning blade 8. The photosensitive drum 3 after the cleaning is subjected to erase-exposure for discharge and then subjected to a repeating cycle commencing from the charging step by the primary charger 11.

The electrostatic image-bearing member (photosensitive drum) comprises a photosensitive layer and a conductive substrate and rotates in the direction of the arrow. The developing sleeve 6 comprising a non-magnetic cylinder as a toner-carrying member rotates so as to move in the same direction as the electrostatic image holding member surface at the developing zone. Inside the non-magnetic cylinder sleeve 6, a multi-pole permanent magnet 15 (magnet roll) as a magnetic field generating means is disposed so as not to rotate. The monocomponent insulating magnetic developer 13 in the developing apparatus is applied onto the non-magnetic cylinder sleeve 6 and the toner particles are provided with, e.g., a negative triboelectric charge due to friction between the sleeve 6 surface and the toner particles. Further, by disposing the elastic blade 9, the thickness of the developer layer is regulated at a thin and uniform thickness (30–300 $\mu$) which is thinner than the spacing between the photosensitive drum 3 and the developing sleeve 6 so that the developer layer does not contact the photosensitive drum 3. The rotation speed of the sleeve 6 is so adjusted that the circumferential velocity of the sleeve 6 is substantially equal to or close to that of the photosensitive drum surface. In the developing zone, an AC bias or a pulsed bias may be applied between the sleeve 6 and the photosensitive drum 3 by the biasing means 12. The AC bias may preferably comprise f=200–4000 Hz and Vpp=500–3000 V.

In the developing zone, the toner particles are transferred to the electrostatic image under the action of an electrostatic force exerted by the electrostatic image bearing surface of the photosensitive drum 3 and the AC bias or pulsed bias.

Another embodiment of the image forming apparatus according to the present invention is described with reference to FIG. 4.

Figure 4:
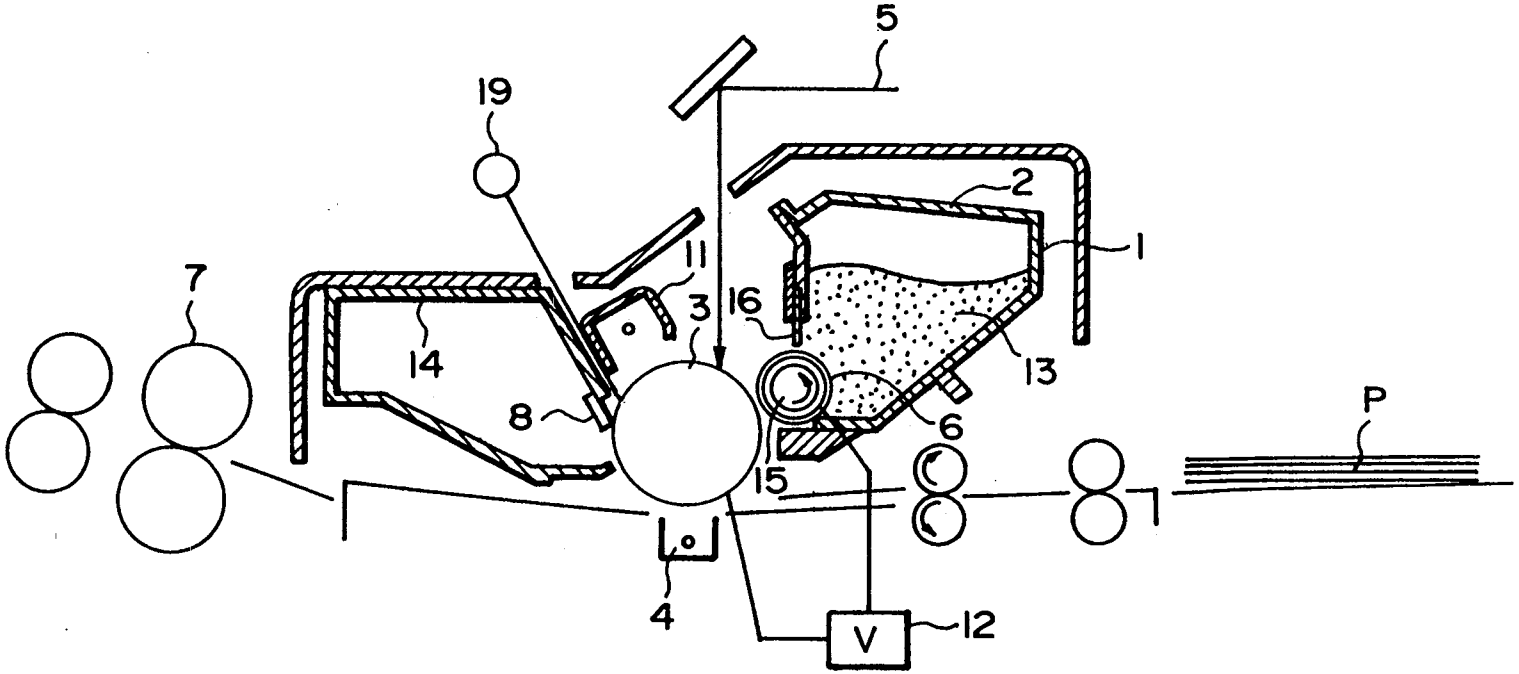
FIG. 4 is a schematic illustration of an embodiment of the image forming apparatus (provided with a magnetic blade) according to the invention.

The image forming apparatus shown in FIG. 4 is different from the one shown in FIG. 3 in that a magnetic doctor blade 16 is used to regulate the thickness of the magnetic developer layer on the developing sleeve. In FIGS. 3 and 4, members denoted by the same reference numeral are identical members.

As the magnetic doctor blade 16, a doctor blade of, e.g., iron is disposed adjacent to the cylinder surface (with a spacing of 50–500 $\mu$m) and opposite to one magnetic pole of the multi-pole permanent magnet, whereby the thickness of the developer layer is regulated at a thin and uniform thickness (30–300 $\mu$m) which is thinner than the spacing between the photosensitive drum 3 and the developing sleeve so that the developer layer does not contact the photosensitive member 3. The rotation speed of the sleeve 6 is so adjusted that the circumferential speed of the sleeve 6 is substantially equal to or close to that of the photosensitive drum surface. It is possible to constitute the magnetic doctor blade 16 with a permanent magnet instead of iron so as to form a counter pole.

In the electrophotographic apparatus, plural members inclusive of some of the above-mentioned electrostatic-image bearing member, such as the photosensitive drum, the developing apparatus and the cleaning means, can be integrally combined to form an apparatus unit, so that the unit can be connected to or released from the apparatus body. For example, at least one of the charging means, developing apparatus and cleaning member can be integrally combined with the photosensitive drum to form a single unit, so that it can be attached to or released from the apparatus body by a guide means, such as a guide rail provided to the body. In this instance, it is also possible to incorporate the charging means and/or the developing apparatus in the apparatus unit.

Figure 5:
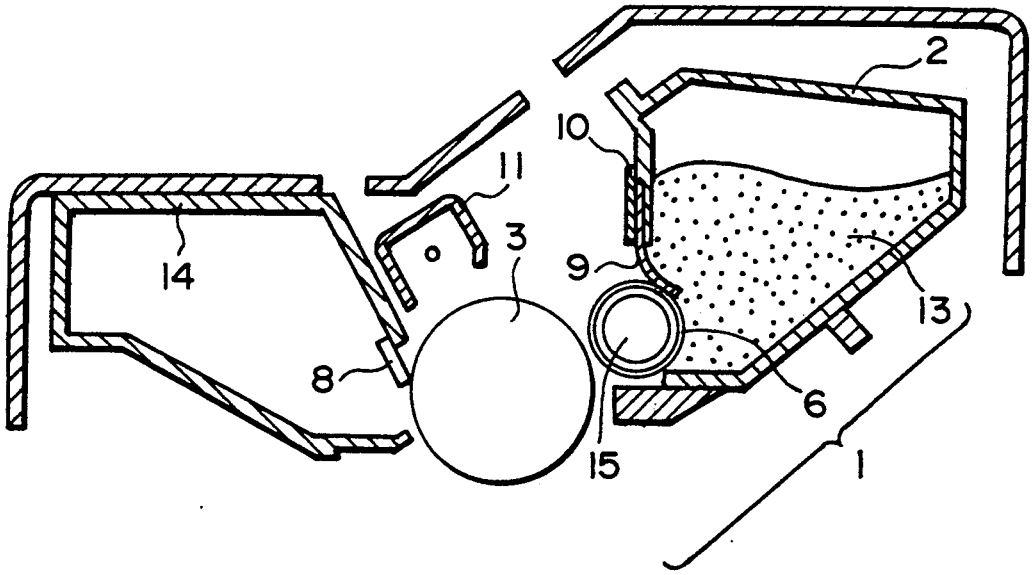
FIG. 5 is a schematic illustration of an embodiment of the apparatus unit according to the invention.

FIG. 5 shows an embodiment of the apparatus unit according to the present invention. In FIG. 5, there is shown an electrophotographic image forming apparatus including an image forming unit (so-called "cartridge") 18 which integrally includes developing apparatus, a drum-shaped latent image-bearing member (photosensitive drum) 3, a cleaner 14, and a primary charger 11.

In the image forming apparatus, when the magnetic developer 13 in the image forming unit 18 is used up, the unit (cartridge) is replaced by a fresh cartridge.

In this embodiment, the developing apparatus 1 contains a monocomponent magnetic developer as the developer 13, and a prescribed electric field is formed between the photosensitive drum 3 and the developing sleeve 6. In order to properly perform the developing step, it is critical to maintain a prescribed spacing between the photosensitive drum 3 and the developing sleeve 6. In this embodiment, the spacing is measured and adjusted to regulate the error to be within $\pm 30$ $\mu$m from the central value of 300 $\mu$m.

The developing apparatus 1 according to the present invention shown in FIG. 5 comprises a developer container 1 for containing a magnetic developer 13, a developing sleeve 6 for carrying the magnetic developer 13 in the developer container 2 and conveying the developer from the container 2 to the developing zone facing the photosensitive drum 3 surface, and an elastic blade 9 for regulating the magnetic developer to a prescribed thickness to form a thin developer layer on the magnetic sleeve 6.

The developing sleeve may assume an arbitrary structure and may ordinarily comprise a non-magnetic sleeve containing a magnet 15 therein. The developing sleeve 6 may assume the shape of a cylindrical revolution body as shown or can assume a recirculating belt. The sleeve may preferably be composed of aluminum or stainless steel.

The elastic blade 9 may generally formed as an elastic plate comprising, e.g., a rubber elastic, such as urethane rubber, silicone rubber and NBR; a metal elastic, such as phosphorus bronze, and stainless steel: or a resinous elastic, such as polyethylene terephthalate, and high density polyethylene. The elastic blade 9 is abutted to the developing sleeve 6 because of its elasticity and fixed to the developer container 2 by means of a blade supporting member 10 composed of a rigid material, such as iron. The elastic bead 9 may preferably be abutted at a linear pressure of 5–80 g/cm in a counterwise direction with respect to the rotation direction of the developing sleeve 6.

Figure 6:
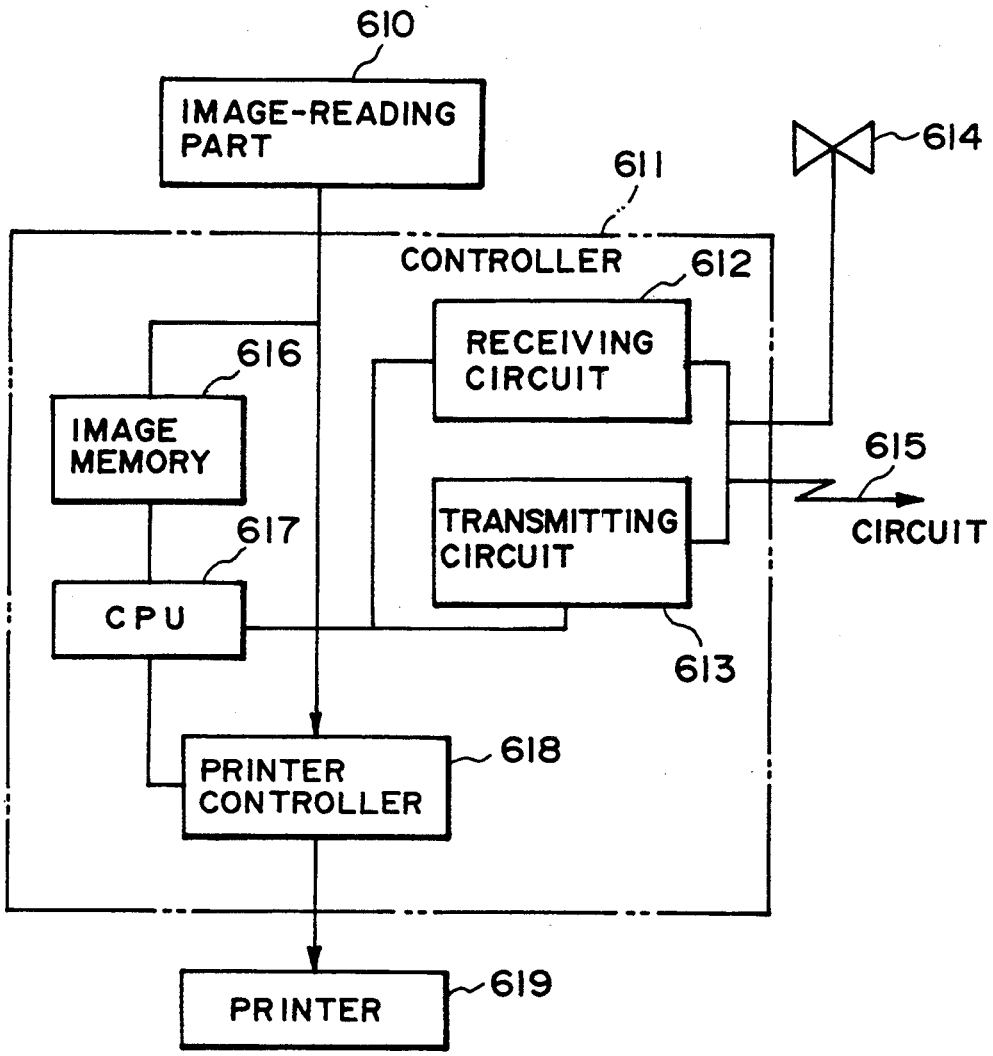
FIG. 6 is a block diagram for illustrating an embodiment of the facsimile apparatus according to the invention.

In case where the image forming apparatus according to the present invention is used as a printer for facsimile, the laser light 5 (as shown in FIG. 3 or 4) may be replaced by exposure light image for printing received data. FIG. 6 is a block diagram for illustrating such an embodiment.

Referring to FIG. 6, a controller 611 controls an image reader (or image reading unit) 610 and a printer 619. The entirety of the controller 611 is regulated by a CPU 617. Data read from the image reader 610 is transmitted through a transmitter circuit 613 to a remote terminal such as another facsimile machine. On the other hand, data received from a remote terminal is transmitted through a receiver circuit 612 to a printer 619. An image memory 616 stores prescribed image data. A printer controller 618 controls the printer 619. A telephone handset 614 is connected to the receiver circuit 612 and the transmitter circuit 613.

More specifically, an image received from a line (or circuit) 615 (i.e., image data received a remote terminal connected by the line) is demodulated by means of the receiver circuit 612, decoded by the CPU 617, and sequentially stored in the image memory 616. When image data corresponding to at least one page is stored in the image memory 616, image recording or output is effected with respect to the corresponding page. The CPU 617 reads image data corresponding to one page from the image memory 616, and transmits the decoded data corresponding to one page to the printer controller 618. When the printer controller 618 receives the image data corresponding to one page from the CPU 617, the printer controller 618 controls the printer 619 so that image data recording corresponding to the page is effected. During the recording by the printer 619, the CPU 617 receives another image data corresponding to the next page.

Thus, receiving and recording of an image may be effected by means of the apparatus shown in FIG. 6 in the above-mentioned manner.

The silicon-containing magnetic iron oxide used in the present invention may be produced, e.g., in the following manner.

Into a ferrous salt aqueous solution, a prescribed amount of a silicic acid compound is added, and then an alkali such as sodium hydroxide is added in an amount at least equivalent to the iron component to prepare an aqueous solution containing ferrous hydroxide. While the pH value of the prepared aqueous solution is maintained at pH 7 or higher (preferably pH 8–10), air is blown thereinto to oxidize the ferrous hydroxide under heating of the aqueous solution to 70° C. or higher, thus first producing seed crystals forming cores of product magnetic iron oxide particles.

Then, into the slurry liquid, an aqueous solution containing ferrous sulfate in about an equivalent amount based on the alkali added above. Air is blown into the liquid while maintaining the pH of the liquid at 6–10, thereby proceeding with the reaction of the ferrous hydroxide to grow the magnetic iron oxide particles with the seed crystals as cores. As the oxidation proceeds, the pH of the liquid is shifted to the acidic side but the liquid should preferably be not allowed to go below 6. It is preferred that, at the final stage of the oxidation, the liquid pH is adjusted so as to localize prescribed amount of siliceous compound at the surface layer and the surface of the magnetic iron oxide particles.

The silicic acid compound added to the system may, for example, be commercially available silicic acid salts, such as sodium silicate, and silicic acid, such as silicic acid sol formed, e.g., by hydrolysis. Other additives, such as aluminum sulfate and alumina, can be added as far as they do not adversely affect the present invention.

As the ferrous salt, it is generally possible to use ferrous sulfate by-produced in titanium production by the sulfuric acid process, ferrous sulfate by-produced during surface-washing of steel plates, and also ferrous chloride, etc.

In the production of magnetic iron oxide in aqueous solution, an iron concentration of 0.5–2 mol/liter is generally used so as to avoid an increase in viscosity accompanying the reaction and in view of the solubility of ferrous sulfate. A lower ferrous sulfate concentration generally tends to provide finer product particles. Further, finer particles tend to be formed when a larger amount of air is used and a lower reaction temperature is used in the reaction.

It is preferred to produce, by the above-described process, silicon-containing magnetic iron oxide particles which principally comprise spherical particles defined by curved surfaces except for plate-like surfaces and almost free from octahedral particles, as observed through a transmission electron microscope, and use the magnetic iron oxide particles for production of the toner.

Hereinbelow, the present invention will be described more specifically based on Production Examples and Examples, wherein "parts" and "%" are by weight.

Production Example 1

Into ferrous sulfate aqueous solution, sodium silicate was added in an amount to provide a silicon content of 1.8 % based on the iron content, and a caustic soda solution in an amount 1.0–1.1 times the equivalent to the ferrous ion, to prepare an aqueous solution containing ferrous hydroxide.

While the aqueous solution was maintained at pH 7–10 (e.g., pH 9), air was blown thereinto to cause oxidation at 80°–90° C., to form a slurry containing seed crystals.

Then, into the slurry, an aqueous solution containing ferrous sulfate in an amount 0.9–1.2 times the equivalent to the previous added alkali (sodium in the sodium silicate and sodium in the caustic soda) was added. Further, while the slurry was maintained at pH 6–10 (e.g., pH 8), air was blown thereinto to cause oxidation, followed by adjustment of the pH at the final stage, to localize siliceous component at the surface of the magnetic iron oxide particles. The produced magnetic iron oxide particles were washed, recovered by filtration, dried and then treated for disintegration of the agglomerates, in ordinary manner, to produce a magnetic iron oxide having properties as shown in Table 2 appearing hereinafter.

As a result of gradual dissolution, the magnetic iron oxide provided dissolved iron and silicon contents as shown in Table 1 measured at 10 min. intervals, and the correlation between the iron (Fe) dissolution rate and the silicon (Si) dissolution rate is summarized in FIG. 1.

Figure 2:
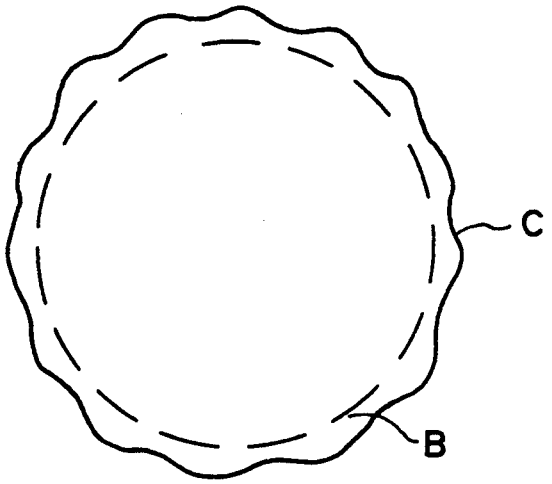
FIG. 2 is a schematic view of a magnetic iron oxide particle for illustration of silicon distribution.

The magnetic iron oxide produced above showed a superficial silicon content C (attributable to siliceous compound attached to the surface C of magnetic iron oxide particle as illustrated in FIG. 2 and dissolved by an alkali solution) at a rate of 17.9 mg/liter, a silicon content B (attributable to siliceous compound contained in the surface layer B of magnetic iron oxide particle illustrated in FIG. 2 and dissolved up to 20% iron dissolution by a hydrochloric acid solution) at a rate of 38.8 mg/liter, and a total silicon content A at a rate of 59.7 mg/liter.

TABLE 1

| | | Dissolution time | | | | | | | | | | | |
|---|---|---|---|---|---|---|---|---|---|---|---|---|---|
| | | 10 | 20 | 30 | 40 | 50 | 60 | 70 | 80 | 90 | 100 | 110 | 120 |
| Iron (Fe) dissolved | mg/1 | 335 | 635 | 1280 | 1790 | 2155 | 2450 | 2650 | 2885 | 3050 | 3215 | 3280 | 3315 |
| Iron (Fe) dissolved | wt. % | 10.1 | 19.2 | 38.6 | 54.0 | 65.0 | 73.9 | 79.9 | 87.0 | 92.0 | 97.0 | 98.9 | 100 |
| Silicon (Si) dissolved | mg/1 | 30.4 | 38.2 | 43.6 | 46.6 | 48.4 | 50.7 | 51.9 | 53.7 | 54.9 | 57.3 | 59.1 | 59.7 |
| Silicon (Si) dissolved | wt. % | 51 | 64 | 73 | 78 | 81 | 85 | 87 | 90 | 92 | 96 | 99 | 100 |

Production Example 2

A magnetic iron oxide having properties as shown in Table 2 was prepared in the same manner as in Production Example 1 except that sodium silicate was added so as to provide a silicon content of 2.9% based on the iron content.

Production Example 3

A magnetic iron oxide having properties as shown in Table 2 was prepared in the same manner as in Production Example 1 except that sodium silicate was added so as to provide a silicon content of 0.9% based on the iron content.

Production Example 4

A magnetic iron oxide having properties as shown in Table 2 was prepared in the same manner as in Production Example 1 except that sodium silicate was added so as to provide a silicon content of 1.7% based on the iron content.

Comparative Production Example 1

A magnetic iron oxide having properties as shown in Table 2 was prepared in the same manner as in Production Example 1 except that no sodium silicate was added.

Comparative Production Example 2

1.5 parts of sodium silicate was blended with 100 wt. parts of the magnetic iron oxide prepared in Comparative Production Example 1 by means of a Henschel mixer to obtain a magnetic iron oxide having properties as shown in Table 1.

TABLE 2

| | Si content (%) | (B/A) × 100 (%) | (C/A) × 100 (%) | Chargeability (uc/g) | Volume resistivity (Ω · cm) | Agglomeration degree (%) | BET surface area ($m^2/g$) | surface area calculated from Dav. ($m^2/g$) | Smoothness (D) | Dav.** (um) | Sphericity ϕ |
|---|---|---|---|---|---|---|---|---|---|---|---|
| Prod. Ex. 1 | 1.8 | 65 | 30 | −48 | $5 \times 10^5$ | 12 | 23.0 | 5.7 | 0.25 | 0.21 | 0.90 |
| 2 | 2.9 | 57 | 25 | −55 | $1 \times 10^3$ | 9 | 29.0 | 6.3 | 0.22 | 0.19 | 0.93 |
| 3 | 0.9 | 83 | 42 | −45 | $5 \times 10^4$ | 25 | 12.0 | 4.3 | 0.36 | 0.28 | 0.84 |
| 4 | 1.7 | 52 | 18 | −47 | $3 \times 10^4$ | 35 | 20.0 | 8.0 | 0.40 | 0.15 | 0.91 |
| Comp. Prod. Ex. 1 | 0 | — | — | −19 | $1 \times 10^3$ | 42 | 5.6 | 5.5 | 0.98 | 0.22 | 0.83 |
| 2 | ca. 1.5%* | — | 100 | −46 | $8 \times 10^5$ | 13 | 35.0 | 5.5 | 0.16 | 0.22 | 0.83 |

*Blended a Henschel mixer.
**Dav.: Average particle size

EXAMPLE 1

| | |
|---|---|
| Styrene/2-ethylhexylacrylate/maleic acid n-butyl half ester copolymer (copolymerization wt. ratio = 7.5/1.5/1, weight-average molecular weight (Mw) = $25 \times 10^4$) | 100 part(s) |
| Magnetic iron oxide of Prod. Ex. 1 | 100 part(s) |
| Negative charge control agent (dialkylsalicylic acid Cr complex) | 1 part(s) |
| Low-molecular weight polypropylene | 3 part(s) |

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a negatively chargeable magnetic toner having a weight-average particle size ($D_4$) of 6.8 μm (containing 0.2 wt. % of magnetic toner particles of 12.7 μm or larger).

100 wt. parts of the magnetic toner and 1.2 wt. parts of hydrophobic silica fine powder treated with hexamethyldisilazane and then with silicone oil were blended by a Henschel mixer to obtain a magnetic developer.

Separately, a commercially available laser beam printer ("LBP-8II", mfd. by Canon K.K.) was remodeled with respect to its apparatus unit (toner cartridge) into one as shown in FIG. 5, wherein a urethane rubber-made elastic blade was abutted to an aluminum developing sleeve at an abutting pressure of 30 g/cm.

Then, the above-prepared magnetic developer was incorporated in the re-modeled laser beam printer and used for image formation in the following manner. An OPC photosensitive drum was primarily charged at −700 V, and an electrostatic latent image for reversal development was formed thereon. The developer was formed in a layer on a developing sleeve 6 (containing magnet) so as to form a clearance (300 μm) from the photosensitive drum at the developing position. An AC bias (f=1,800 Hz and $V_{PP}$=1,600 V) and a DC bias ($V_{DC}$=−500 V) were applied to the sleeve, and an electrostatic image having a light-part potential of −170 V was developed by the reversal development mode, to form a magnetic toner image on the OPC photosensitive drum. The thus-formed toner image was transferred to plain paper under application of a positive transfer voltage, and then fixed to the plain paper by passing through a hot-pressure roller fixer.

In this way, successive image formation was performed up to 6000 sheets in a normal temperature - normal humidity (23.5° C. - 60% RH) environment while replenishing the developer, as required.

Figure 7:
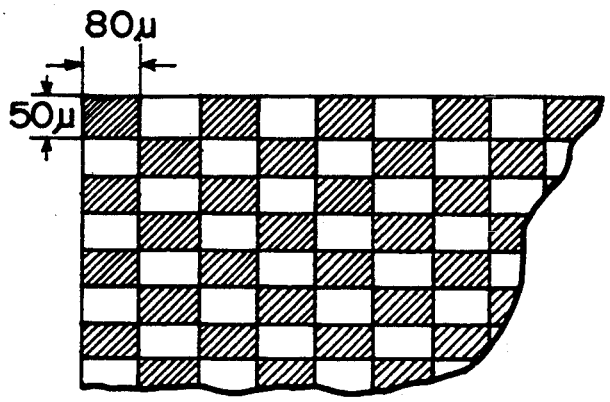
FIG. 7 is an illustration of a checker pattern for testing the developing performance of a magnetic toner.
Figure 8:
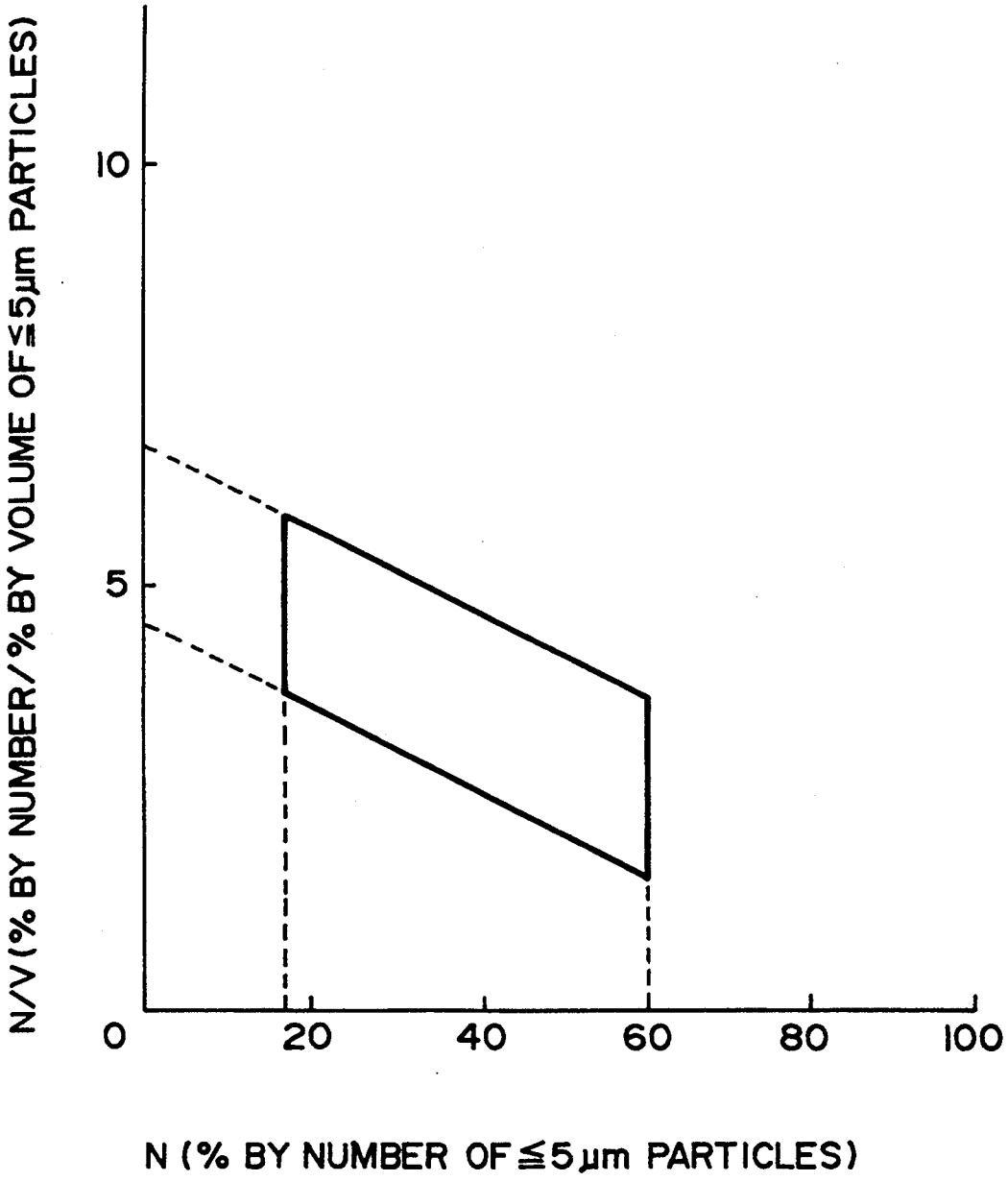
FIG. 8 is a graph defining a quantitative range of toner particles having a particle size of at most 5 μm giving a preferred particle size distribution according to the invention.

The images were evaluated with respect to an image density as measured by a MacBeth reflection densitometer, fog as measured by comparison between a fresh plain paper and a plain paper on which a solid white image was printed with respect to whiteness as measured by a reflection meter (mfd. by Tokyo Denshoku K.K.), and a dot reproducibility after image formation of a checker pattern shown in FIG. 7. The results are shown in Table 3 appearing hereinafter.

Similar image forming tests were performed in a high temperature - high humidity (32.5° C. - 85% RH) environment and in a low temperature - low humidity (10° C. - 15% RH) environment. The results are also shown in Table 3.

EXAMPLE 2

| | |
|---|---|
| Styrene/n-butyl acrylate copolymer (wt. ratio = 8/2, Mw = 28 × $10^4$) | 100 part(s) |
| Magnetic iron oxide of Prod. Ex. 2 | 60 part(s) |
| Negative charge control agent (monoazo dye Cr complex) | 0.8 part(s) |
| Low-molecular weight polypropylene | 3 part(s) |

A blend of the above ingredients was melt kneaded at 140° C. by means of a twin-screw extruder. The kneaded product was cooled, coarsely crushed by a hammer mill, finely pulverized by a jet mill, and classified by a wind-force classifier to obtain a negatively chargeable magnetic toner having a weight-average particle size ($D_4$) of 11.4 μm (containing 33 wt. % of magnetic toner particles of 12.7 μm or larger.)

100 parts of the magnetic toner and 0.6 part of hydrophobic colloidal silica treated with dimethylsilicone oil were blended by a Henschel mixer to prepare a magnetic developer.

The magnetic developer was charged in an apparatus unit of a laser beam printer ("LBP-8II") and evaluated by image formation in the same manner as in Example 1. The results are shown in Table 3.

EXAMPLE 3

| | |
|---|---|
| Styrene/n-butyl acrylate copolymer (wt. ratio = 8/2, Mw = 3 × $10^4$) | 100 part(s) |
| Magnetic iron oxide of Prod. Ex. 3 | 120 part(s) |

-continued

| | |
|---|---|
| Negative charge control agent (Monoazo dye Cr complex) | 2 part(s) |
| Low-molecular weight polypropylene | 3 part(s) |

A magnetic toner having a weight-average particle size ($D_4$) of 4 μm (containing 0 wt. % of particles of 12.7 μm or larger) was prepared from the above ingredients in the same manner as in Example 1.

100 parts of the magnetic toner and 1.6 part of hydrophobic colloidal silica treated with silicone oil were blended by a Henschel mixer to prepare a magnetic developer.

The magnetic developer was subjected to up to 6000 sheets of image forming tests in the same manner as in Example 1. The results are shown in Table 3.

EXAMPLE 4

| | |
|---|---|
| Styrene/n-ethylhexyl acrylate/maleic acid n-butyl half ester copolymer (wt. ratio = 7.5/1.5/1; Mw = 25 × $10^4$) | 100 part(s) |
| Magnetic iron oxide of Prod. Ex. 4 | 90 part(s) |
| Negative charge control agent (dialkylsalicylic acid Cr complex) | 1 part(s) |
| Low-molecular weight polypropylene | 3 part(s) |

A magnetic toner having a weight-average particle size ($D_4$) of 8.5 μm (containing 4 wt. % of toner particles of 12.7 μm or larger) was prepared from the above ingredients in the same manner as in Example 1.

100 parts of the magnetic toner and 1 part of hydrophobic colloidal silica treated with hexamethyldisilazane and then with silicone oil were blended by a Henschel mixer to obtain a magnetic developer.

The magnetic developer was charged in an apparatus unit of a laser beam printer ("LBP-8II") which had been remodeled to provide a copying speed of 16 sheets/min. (A4 longitudinal feed), and subjected to image formation tests in the same manner as in Example 1. The results are shown in Table 3.

EXAMPLE 5

| | |
|---|---|
| Styrene/n-butyl acrylate copolymer (wt. ratio = 8/2, Mw = 30 × $10^4$) | 100 part(s) |
| Magnetic iron oxide of Prod. Ex. 1 | 50 part(s) |
| Negative charge control agent (Monoazo dye Cr complex) | 0.8 part(s) |
| Low-molecular weight polypropylene | 3 part(s) |

A magnetic toner having a weight-average particle size ($D_4$) of 13 μm (containing 45 wt. % of particles of 12.7 μm or larger) was prepared from the above ingredients in the same manner as in Example 1.

100 parts of the magnetic toner and 0.4 part of hydrophobic colloidal silica treated with silicone oil were blended by a Henschel mixer to prepare a magnetic developer.

The magnetic developer was charged in an apparatus unit (toner cartridge) of a commercially available laser beam printer ("LBP-A404", mfd. by Canon K.K.) and subjected to up to 4000 sheets of image forming tests in the same manner as in Example 1. The results are shown in Table 3.

Comparative Example 1

A magnetic toner having a weight-average particle size of 7 μm (containing 0.3 wt. % of toner particles of 12.7 μm or larger) was prepared in the same manner as in Example 1 except for using the magnetic iron oxide of Comparative Production Example 1. From the magnetic toner, a magnetic developer was prepared and evaluated by image formation tests in the same manner as in Example 1. The results are shown in Table 3.

Comparative Example 2

A magnetic toner having a weight-average particle size of 8.7 μm (containing 5 wt. % of toner particles of 12.7 μm or larger) was prepared in the same manner as in Example 4 except for using the magnetic iron oxide of Comparative Production Example 2. From the magnetic toner, a magnetic developer was prepared and evaluated by image formation tests in the same manner as in Example 4. The results are shown in Table 3.

Comparative Example 3

A magnetic toner was prepared by using the magnetic iron oxide of Production Example 1 in the same manner as in Example 1 but the particle size distribution was changed to have a weight-average particle size of 14 μpm (containing 60 wt. % of toner particles of 12.7 μm or larger). From the magnetic toner, a magnetic developer was prepared and evaluated by image formation tests in the same manner as in Example 1. The results are shown in Table 3.

As shown in Table 3, compared with the magnetic developer of Example 1, the magnetic developer showed inferior dot reproducibility and caused noticeable toner scattering.

TABLE 3*

| | Image density | | | | Fog | |
|---|---|---|---|---|---|---|
| | N.T.-N.H. | | | | L.T.-L.H. | |
| | Initial stage | Final stage | H.T.-H.H. Final stage | L.T.-L.H. Final stage | After 3000 sheets | Dot reproducibility N.T.-N.H. |
| Ex. 1 | 1.45 | 1.46(6000) | 1.38(6000) | 1.45 | 0.8% | ∘ (10000) |
| 2 | 1.42 | 1.43(10000) | 1.40(10000) | 1.42 | 1.0% | ∘ (10000) |
| 3 | 1.41 | 1.46(6000) | 1.37(6000) | 1.41 | 1.4% | ∘ (6000) |
| 4 | 1.43 | 1.42(10000) | 1.38(10000) | 1.41 | 0.7% | ∘ (10000) |
| 5 | 1.43 | 1.44(4000) | 1.39(4000) | 1.43 | 0.6% | ∘Δ(4000) |
| Comp. Ex. 1 | 1.40 | 1.07(6000) | 1.01(6000) | 1.12 | 6.0% | x (10000) |
| 2 | 1.41 | 1.09(10000) | 1.00(10000) | 1.18 | 6.5% | x (6000) |
| 3 | 1.42 | 1.41 | 1.20 | 1.40 | 1.0% | x |

*1) N.T.-N.H. = normal temperature-normal humidity (23.5° C.-60% RH)
H.T.-H.H. = high temperature-high humidity (32.5° C.-85% RH)
L.T.-L.H. = low temperature-low humidity (10° C.-15% RH)
2) The number in the parentheses refers to the number of sheets used for successive image formation.
3) Evaluation standards are supplemented in the following page.

Evaluation notes (1) Fog was calculated by the following formula based on "whiteness" measured by using "REFLECTOMETER" (trade name, mfd. by Tokyo Denshoku K.K.)

Fog (%) = [whiteness (%) of white plain paper] − [whiteness (%) of white plain paper after printing of solid white image thereon]

If the fog value is 1.5% or below, it is regarded as a good image.

(b) Dot reproducibility was evaluated by the reproducibility of a checker pattern as shown in FIG. 7 including 100 unit square dots each measuring 80 μm×50 μm, by observation through a microscope while noticing the clearness of the image, particularly scattering to the non-image parts, and the number of defects (lack) of black dots. The symbols denote the following results:

o: Less than 2 defects/100 dots
oΔ: 3–5 defects
Δ: 6–10 defects
x: 11 or more defects.

As is understood from the above results, the environmental stability and developing performances of a magnetic toner rich in fine particles characterized by a weight-average particle size of at most 13.5 μm and at most 50 wt. % of magnetic toner particles of 12.7 μm or larger, can be improved by incorporating a magnetic iron oxide having a characteristic silicon (Si) distribution.

EXAMPLE 6

| | |
|---|---|
| Styrene/n-butyl acrylate/maleic acid n-butyl half ester copolymer (copolymerization wt. ratio = 7.0/2.5/0.5, weight-average molecular weight (Mw) = 26 × $10^4$) | 100 part(s) |
| Magnetic iron oxide of Prod. Ex. 1 | 100 part(s) |
| Negative charge control agent (dialkylsalicylic acid Cr complex) | 1 part(s) |
| Low-molecular weight polypropylene | 3 part(s) |

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a negatively chargeable magnetic toner having a weight-average particle size ($D_4$) of 6.9 μm (containing 0.2 wt. % of magnetic toner particles of 12.7 μm or larger).

100 wt. parts of the magnetic toner, 0.10 wt. parts of resin fine particles A shown in Table 4 appearing hereinafter and 1.2 wt. parts of hydrophobic silica fine powder treated with hexamethyldisilazane and then with silicone oil were blended by a Henschel mixer to obtain a magnetic developer.

Separately, a commercially available laser beam printer ("LBP-8II", mfd. by Canon K.K.) was remodeled with respect to its apparatus unit (toner cartridge) into one as shown in FIG. 5, wherein a urethane rubber-made elastic blade was abutted to an aluminum developing sleeve at an abutting pressure of 30 g/cm.

Then, the above-prepared magnetic developer was incorporated in the re-modeled laser beam printer and used for image formation in the following manner. An OPC photosensitive drum was primarily charged at −700 V, and an electrostatic latent image for reversal development was formed thereon. The developer was formed in a layer on a developing sleeve 6 (containing magnet) so as to form a clearance (300 μm) from the photosensitive drum at the developing position. An AC bias (f=1,800 Hz and $V_{PP}$=1,600 V) and a DC bias ($V_{DC}$=−500 V) were applied to the sleeve, and an electrostatic image having a light-part potential of −170 V was developed by the reversal development mode, to form a magnetic toner image on the OPC photosensitive drum. The thus-formed toner image was transferred to plain paper under application of a positive transfer voltage, and then fixed to the plain paper by passing through a hot-pressure roller fixer.

In this way, successive image formation was performed up to 8000 sheets in a normal temperature - normal humidity (23.5° C. - 60% RH) environment while replenishing the developer, as required.

The images were evaluated with respect to an image density as measured by a MacBeth reflection densitometer, a fog as measured by comparison between a fresh plain paper and a plain paper on which a solid white image was printed with respect to whiteness as measured by a reflection meter (mfd. by Tokyo Denshoku K.K.), and a dot reproducibility after image formation of a checker pattern shown in FIG. 7. The results are shown in Table 5 appearing hereinafter.

Similar image forming tests were performed in a high temperature - high humidity (32.5° C. - 85% RH) environment and in a low temperature - low humidity (10° C. - 15% RH) environment. The results are also shown in Table 5.

EXAMPLE 7

| | |
|---|---|
| Styrene/2-ethylhexyl acrylate/maleic acid n-butyl half ester (wt. ratio = 7.5/1.5/1.0, Mw = 28 × $10^4$) | 100 part(s) |
| Magnetic iron oxide of Prod. Ex. 2 | 60 part(s) |
| Negative charge control agent (monoazo dye Cr complex) | 0.9 part(s) |
| Low-molecular weight polypropylene | 3 part(s) |

A blend of the above ingredients was melt kneaded at 140° C. by means of a twin-screw extruder. The kneaded product was cooled, coarsely crushed by a hammer mill, finely pulverized by a jet mill, and classified by a wind-force classifier to obtain a negatively chargeable magnetic toner having a weight-average particle size ($D_4$) of 11.2 μm (containing 33 wt. % of magnetic toner particles of 12.7 μm or larger.)

100 parts of the magnetic toner, 0.07 part of resin fine particles B shown in Table 4 and 0.6 part of hydrophobic colloidal silica treated with dimethylsilicone oil were blended by a Henschel mixer to prepare a magnetic developer.

The magnetic developer was charged in an apparatus unit of a laser beam printer ("LBP-8II") and evaluated by up to 8000 sheets of image formation in the same manner as in Example 6. The results are shown in Table 5.

EXAMPLE 8

| | |
|---|---|
| Styrene/n-butyl acrylate copolymer (wt. ratio = 7/3, Mw = 30 × $10^4$) | 100 part(s) |
| Magnetic iron oxide of Prod. Ex. 3 | 120 part(s) |
| Negative charge control agent (Monoazo dye Cr complex) | 2 part(s) |
| Low-molecular weight polyproylene | 3 part(s) |

A magnetic toner having a weight-average particle size ($D_4$) of 4.1 μm (containing 0 wt. % of particles of 12.7 μm or large) was prepared from the above ingredients in the same manner as in Example 6.

100 parts of the magnetic toner, 0.3 part of resin fine particles C shown in Table 4 and 1.6 part of hydrophobic colloidal silica treated with silicone oil were blended by a Henschel mixer to prepare a magnetic developer.

The magnetic developer was subjected to up to 8000 sheets of image forming tests in the same manner as in Example 6. The results are shown in Table 5.

EXAMPLE 9

| | |
|---|---|
| Styrene/n-ethylhexyl acrylate (wt. ratio = 7.5/2.5; Mw = 25 × $10^4$) | 100 part(s) |
| Magnetic iron oxide of Prod. Ex. 4 | 90 part(s) |
| Negative charge control agent (dialkylsalicylic acid Cr complex) | 1.2 part(s) |
| Low-molecular weight polypropylene | 3 part(s) |

A magnetic toner having a weight-average particle size ($D_4$) of 8.5 μm (containing 4 wt. % of toner particles of 12.7 μm or larger) was prepared from the above ingredients in the same manner as in Example 6.

100 parts of the magnetic toner, 0.03 part of resin fine particles D shown in table 4 and 1 part of hydrophobic colloidal silica treated with hexamethyldisilazane and then with silicone oil, were blended by a Henschel mixer to obtain a magnetic developer.

The magnetic developer was charged in an apparatus unit of a laser beam printer ("LBP-8II") which had been remodeled to provide a copying speed of 16 sheets/min. (A4 longitudinal feed), and subjected to up to 12,000 sheets of image formation tests in the same manner as in Example 6. The results are shown in Table 5.

EXAMPLE 10

| | |
|---|---|
| Styrene/n-butyl acrylate/maleic acid n-butyl half ester copolymer (wt. ratio = 8/1.5/1, Mw = 29 × $10^4$) | 100 part(s) |
| Magnetic iron oxide of Prod. Ex. 1 | 50 part(s) |
| Negative charge control agent Monoazo dye Cr complex) | 0.8 part(s) |
| Low-molecular weight polypropylene | 3 part(s) |

A magnetic toner having a weight-average particle size ($D_4$) of 13 μm (containing 45 wt. % of particles of 12.7 μm or large) was prepared from the above ingredients in the-same manner as in Example 6.

100 parts of the magnetic toner, 0.05 part of resin fine particles A shown in Table 4 and 0.4 part of hydrophobic colloidal silica treated with silicone oil, were blended by a Henschel mixer to prepare a magnetic developer.

The magnetic developer was charged in an apparatus unit (toner cartridge) of a commercially available laser beam printer ("LBP-A404", mfd. by Canon K.K.) and subjected to up to 5000 sheets of image forming tests in the same manner as in Example 6. The results are shown in Table 5.

Comparative Example 4

A magnetic toner having a weight-average particle size of 7.1 μm (containing 0.3 wt. % of toner particles of 12.7 μm or larger) was prepared in the same manner as in Example 6 except for using the magnetic iron oxide of Comparative Production Example 1. From the magnetic toner, a magnetic developer was prepared and evaluated by image formation tests in the same manner as in Example 6. The results are shown in Table 5.

Comparative Example 5

A magnetic toner was prepared by using the magnetic iron oxide of Production Example 1 in the same manner as in Example 6 but the particle size distribution was changed to have a weight-average particle size of 14 μm (containing 60 wt. % of toner particles of 12.7 μm or larger). From the magnetic toner, a magnetic developer was prepared and evaluated by image formation tests in the same manner as in Example 6. The results are shown in Table 5.

As shown in Table 5, compared with the magnetic developer of Example 6, the magnetic developer showed inferior dot reproducibility and caused noticeable toner scattering.

TABLE 4

| Resin fine particles | Composition | Particle size (μm) | Triboelectric chargeability (μc/g) |
|---|---|---|---|
| A | styrene/methyl methacrylate/2-ethylhexyl acrylate/methacrylic acid | 0.60 | −30 |
| B | styrene/acrylic acid/ 2-ethylhexyl acrylate | 0.40 | −35 |
| C | styrene/methyl methacrylate/acrylic acid/butyl acrylate | 0.90 | −10 |
| D | styrene/butyl methacrylate | 0.04 | −50 |

-continued

| | |
|---|---|
| weight (Mw) = 27 × $10^4$) | |
| Magnetic iron oxide of Prod. Ex. 1 | 100 part(s) |
| Negative charge control agent (dialkylsalicylic acid Cr complex) | 1 part(s) |
| Low-molecular weight polypropylene | 3 part(s) |

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a negatively chargeable magnetic toner having a weight-average particle size ($D_4$) of 6.8 μm.

The particle size distribution of the thus prepared negatively chargeable magnetic toner was measured by a Coulter counter ("Model TA-II", available from Coulter Electronics Inc.) equipped with a 100 μm-aperture as described hereinbefore. The measured data are shown in Table 6 appearing hereinafter. The particle size distribution data characterizing the magnetic toner of the invention and some data regarding the magnetic iron oxide used therein are shown in Table 7.

100 wt. parts of the magnetic toner and 1.2 wt. parts of hydrophobic silica fine powder treated with hexamethyldisilazane and then with silicone oil were blended by a Henschel mixer to obtain a magnetic developer.

Separately, a commercially available laser beam printer ("LBP-8II", mfd. by Canon K.K.) was remodeled so a to provide a resolution of 600 dpi and remodeled with respect to its developing apparatus as shown in Table 3, wherein a urethane rubber-made elastic blade was abutted to an aluminum-made developing sleeve at an abutting pressure of 30 g/cm. Then, the above-prepared magnetic developer was charged in the re-modeled laser beam printer and then subjected to 10000 sheets of successive image formation test in the same manner as in Example 6 in a low temperature—low humidity environment (15° C. 10%RH). As a result, very good results were attained as shown in Table 8.

Incidentally, the image density listed refers to an average of values measured at 5 points by a MacBeth

TABLE 5

| | Image density N.T.-N.H. Initial stage | Image density N.T.-N.H. Final stage | Image density H.T.-H.H. Final stage | Image density L.T.-L.H. Final stage | Fog L.T.-L.H. After 3000 sheets | Dot reproducibility N.T.-N.H. |
|---|---|---|---|---|---|---|
| Ex. 1 | 1.46 | 1.46(8000) | 1.40(8000) | 1.46 | 0.8% | ○ (8000) |
| 2 | 1.43 | 1.44(12000) | 1.42(12000) | 1.42 | 0.9% | ○ (12000) |
| 3 | 1.41 | 1.40(8000) | 1.38(8000) | 1.42 | 1.3% | ○ (8000) |
| 4 | 1.42 | 1.43(12000) | 1.40(12000) | 1.43 | 0.6% | ○ (12000) |
| 5 | 1.43 | 1.43(5000) | 1.41(5000) | 1.42 | 0.5% | ○Δ(5000) |
| Comp. Ex. 1 | 1.40 | 1.03(8000) | 0.95(8000) | 1.08 | 6.5% | x |
| 2 | 1.42 | 1.40(12000) | 1.18(12000) | 1.40 | 1.0% | x (8000) |

* 1) N.T.-N.H. = normal temperature-normal humidity (23.5° C.-60% RH)
H.T.-H.H. = high temperature-high humidity (32.5° C.-85% RH)
L.T.-L.H. = low temperature-low humidity (10° C.-15% RH)
2) The number in the parentheses refers to the number of sheets used for successive image formation.
3) Evaluation standards are the same as for Table 3.

EXAMPLE 11

| | |
|---|---|
| Styrene/2-ethylhexylacrylate/maleic acid n-butyl half ester copolymer (copolymerization wt. ratio = 7/2/1, weight-average molecular | 100 part(s) |

reflection densitometer. The consumption refers to an average of the amount of the consumed toner per A4-size sheet when an image with an image area percentage of 4% was successively printed on 1000-999 sheets and 4000–4999 sheets.

EXAMPLES 12–14

Magnetic toners having weight-average particle sizes and particle size distributions, as shown in Table 7 were prepared in the same manner as in Example 11 except that the magnetic iron oxides of Production Examples 2, 3 and 4 were used respectively. From these magnetic toners, magnetic developers were prepared and evaluated in the same manner as in Example 11, whereby good results were obtained as shown in Table 8.

EXAMPLES 15 and 16

Magnetic toners were prepared in the same manner as in Example 11 except for their weight-average particle sizes and particle size distributions as shown in Table 7. From these magnetic toners, magnetic developers were prepared and evaluated in the same manner as in Example 11, whereby good successive printing characteristics were exhibited as shown in Table 8 while showing somewhat inferior dot reproducibility.

Comparative Example 6 and 7

Magnetic toners having weight-average particle sizes and particle size distributions, as shown in Table 7 were prepared in the same manner as in Example 11 except that the magnetic iron oxides of Comparative Production Examples 1 and 2 were used respectively. From these magnetic toners, magnetic developers were prepared and evaluated in the same manner as in Example 11, whereby they exhibited clearly inferior successive printing characteristics as shown in Table 8 compared with those of Examples 11–16.

TABLE 6

| Size (μm) | Number | % by number (N) Distribution | % by number (N) Accumulation | % by volume (V) Distribution | % by volume (V) Accumulation |
|---|---|---|---|---|---|
| 2.00–2.52 | 2507 | 2.0 | 2.0 | 0.0 | 0.0 |
| 2.52–3.17 | 5999 | 4.8 | 6.8 | 0.5 | 0.5 |
| 3.17–4.00 | 15362 | 12.2 | 19.0 | 3.0 | 3.5 |
| 4.00–5.00 | 30718 | 24.4 | 43.4 | 11.7 | 15.2 |
| 5.00–6.35 | 35976 | 28.6 | 71.6 | 25.7 | 40.9 |
| 6.35–8.00 | 27291 | 21.7 | 93.6 | 37.8 | 78.6 |
| 8.00–10.08 | 7635 | 6.1 | 99.7 | 19.7 | 98.3 |
| 10.08–12.70 | 377 | 0.3 | 100.0 | 1.7 | 100.0 |
| 12.70–16.00 | 7 | 0.0 | 0.0 | 0.0 | 0.0 |
| 16.00–20.20 | 0 | 0.0 | 0.0 | 0.0 | 0.0 |
| 20.20–25.40 | 0 | 0.0 | 0.0 | 0.0 | 0.0 |
| 25.40–32.00 | 0 | 0.0 | 0.0 | 0.0 | 0.0 |
| 32.00–40.30 | 0 | 0.0 | 0.0 | 0.0 | 0.0 |
| 40.30–50.80 | 0 | 0.0 | 0.0 | 0.0 | 0.0 |

TABLE 7

| | Magnetic iron oxide | | | Magnetic toner | | | | |
|---|---|---|---|---|---|---|---|---|
| | Si content (%) | (B/A) × 100 (%) | (C/A) × 100 (%) | Weight-average particle size (DA) | ≦5 μm (number %) | 6.35–10.08 μm (number %) | ≧12.7 μm (vol. %) | k |
| Ex. 6 | 1.8 | 65 | 30 | 6.8 | 43.4 | 27.8 | 0 | 5.02 |
| 7 | 2.9 | 57 | 25 | 6.8 | 41.4 | 29.3 | 0 | 5.04 |
| 8 | 0.9 | 83 | 42 | 6.7 | 45.3 | 28.7 | 0 | 4.94 |
| 9 | 1.7 | 52 | 18 | 6.1 | 50.2 | 20.6 | 0 | 5.00 |
| 10 | 1.8 | 65 | 30 | 7.9 | 35.1 | 36.7 | 0.3 | 5.74 |
| 11 | 1.8 | 65 | 30 | 7.3 | 33.8 | 31.4 | 0.1 | 4.91 |
| Comp. Ex. 3 | 0 | — | — | 6.7 | 39.8 | 30.5 | 0 | 4.88 |
| 4 | ca. 1.5%* | — | 100 | 6.8 | 42.3 | 30.2 | 0 | 4.93 |

*Blended by a Henschel mixer

TABLE 8

| | Image density Initial | Image density Final | Fog* During 10000 sheets | Dot reproducibility After 3000 sheets | Consumption (g/A4-sheet) |
|---|---|---|---|---|---|
| Ex. 11 | 1.45 | 1.44 | 1.5% | ○ | 0.046 |
| 12 | 1.42 | 1.42 | 1.6% | ○ | 0.044 |
| 13 | 1.43 | 1.42 | 1.8% | ○ | 0.043 |
| 14 | 1.41 | 1.41 | 1.4% | ○ | 0.040 |
| 15 | 1.47 | 1.49 | 1.2% | ○△ | 0.048 |
| 16 | 1.47 | 1.47 | 0.9% | ○△ | 0.055 |
| Comp. Ex. 6 | 1.42 | 1.09 | 6.2% | △ | 0.062 |
| 7 | 1.41 | 1.22 | 6.5% | ○△ | 0.060 |

*Evaluation standards of the Fog and Dot reproducibility are the same as for Table 3.

EXAMPLE 17

| | |
|---|---|
| Styrene/butyl acrylate/divinylbenzene copolymer (copolymerization wt. ratio = 80/19.5/0.5, weight-average molecular weight (Mw) = $32 \times 10^4$) | 100 part(s) |
| Magnetic iron oxide of Prod. Ex. 1 | 100 part(s) |

-continued

| | |
|---|---|
| Monoazo dye Cr complex | 2 part(s) |
| Low-molecular weight polypropylene | 4 part(s) |

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type wind-force classifier to obtain a classified powder product. Ultra-fine powder and coarse power were simultaneously removed from the classified powder by means of a multi-division classifier to obtain a negatively chargeable magnetic toner having a weight-average particle size of 6.3 μm.

Separately, 100 parts of silica fine powder ("Aerosil #300", mfd. by Nihon Aerosil K.K.) was treated with 30 parts of dimethyldichlorosilane to provide an attached carbon content of 2.2 wt. %, and then mixed with 15 parts of dimethylsilicone oil ("KF-96 100cs", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 6.5 wt. % (that is, attachment of 4.3 wt. % carbon by treatment with the silicone oil).

Then, 100 parts of the above-prepared magnetic toner and 1.0 part of the treated silica fine powder were blended by a Henschel mixer to obtain a magnetic developer.

Separately, a commercially available laser beam printer ("LBP-8II", mfd. by Canon K.K.) was remodeled to provide an increased printing speed of 16 sheets/min. from 8 sheets/min.

Then, the above-prepared magnetic developer was incorporated in the re-modeled laser beam printer and used for image formation in the same manner as in the previous Examples.

Thus, successive image formation was performed up to 8000 sheets in a normal temperature normal humidity (23.5° C.—60%RH) environment.

Similarly as in the previous Examples, the images were evaluated with respect to an image density as measured by a MacBeth reflection densitometer, fog as measured by comparison between a fresh plain paper and a plain paper on which a solid white image was printed with respect to whiteness as measured by a reflection meter (mfd. by Tokyo Denshoku K.K.), and a dot reproducibility after image formation of a checker pattern shown in FIG. 7, and also a transfer failure (in an inner part of an image, i.e., a hollow image defect) during transfer onto a transparency film. The results are shown in Table 9 appearing hereinafter.

Similar image forming tests were performed in a high temperature—high humidity (32.5° C.—85%RH) environment and in a low temperature—low humidity (10° C.—15%RH) environment. The results are also shown in Table 9.

EXAMPLE 18

| | |
|---|---|
| Styrene/butyl acrylate/divinylbenzene copolymer (wt. ratio = 80/19.5/0.5, Mw = 32 × $10^4$) | 100 part(s) |
| Magnetic iron oxide of Prod. Ex. 2 | 120 part(s) |
| Monoazo dye C complex | 3 part(s) |
| Low-molecular weight polypropylene | 4 part(s) |

A magnetic toner having a weight-average particle size of 5.4 μm was prepared from the above ingredients otherwise in the same manner as in Example 17.

Separately, 100 parts of silica fine powder ("Aerosil #200", mfd. by Nihon Aerosil K.K.) was treated with 20 parts of dimethyldichlorosilane to provide an attached carbon content of 1.1 wt. %, and then mixed with 15 parts of dimethylsilicone oil ("KF-96 100cs", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 5.2 wt. % (that is, attachment of 4.1 wt. % carbon by treatment with the silicone oil).

Then, 100 parts of the above-prepared magnetic toner and 1.6 parts of the treated silica fine powder were blended by a Henschel mixer to obtain a magnetic developer.

The magnetic developer was used for image formation tests in the same manner as in Example 17. The results are also shown in Table 9.

EXAMPLE 19

| | |
|---|---|
| Styrene/butyl acrylate/divinylbenzene copolymer (wt. ratio = 80/19.5/0.5, Mw = 32 × $10^4$) | 100 part(s) |
| Magnetic iron oxide of Prod. Ex. 3 | 80 part(s) |
| Monoazo dye Cr complex | 0.8 part(s) |
| Low-molecular weight polypropylene | 3 part(s) |

A magnetic toner having a weight-average particle size of 7.8 μm was prepared from the above ingredients in the same manner as in Example 17.

100 parts of the magnetic toner and 1.0 part of the treated silica fine powder of Example 18 were blended by a Henschel mixer to prepare a magnetic developer.

The magnetic developer was subjected to image forming tests in the same manner as in Example 17. The results are shown in Table 9.

EXAMPLE 20

| | |
|---|---|
| Styrene/ethylhexyl acrylate/divinylbenzene copolymer (wt. ratio = 80/19.5/0.5; Mw = 32 × $10^4$) | 100 part(s) |
| Magnetic iron oxide of Prod. Ex. 4 | 90 part(s) |
| Monoazo dye Cr complex | 1 part(s) |
| Low-molecular weight polypropylene | 3 part(s) |

A magnetic toner having a weight-average particle size of 6.9 μm was prepared from the above ingredients in the same manner as in Example 18.

Separately, 100 parts of silica fine powder ("Aerosil #200", mfd. by Nihon Aerosil K.K.) was treated with 30 parts of trimethylchlorosilane to provide an attached carbon content of 3.5 wt. %, and then mixed with 10 parts of dimethylsilicone oil ("KF-96 100cs", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 7.1 wt. % (that is, attachment of 3.6 wt. % carbon by treatment with the silicone oil).

Then, 100 parts of the above-prepared magnetic toner and 1.0 part of the treated silica fine powder were blended by a Henschel mixer to obtain a magnetic developer.

The magnetic developer was used for image formation tests in the same manner as in Example 17. The results are also shown in Table 9.

EXAMPLE 21

100 parts of silica fine powder ("Aerosil #200", mfd. by Nihon Aerosil K.K.) was treated with 25 parts of dimethyldichlorosilane to provide an attached carbon content of 1.5 wt. %, and then mixed with 5 parts of dimethylsilicone oil ("KF-96 100cs", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 4.6 wt. % (that is, attachment of 3.1 wt. % carbon by treatment with the silicone oil).

Then, 1.0 part of the treated silica fine powder thus obtained and 100 parts of the magnetic toner of Example 20 were blended by a Henschel mixer to obtain a magnetic developer.

The magnetic developer was subjected to image formation tests in the same manner as in Example 17. The results are also shown in Table 9.

EXAMPLE 22

100 parts of silica fine powder ("Aerosil #200", mfd. by Nihon Aerosil K.K.) was treated with 20 parts of dimethyldichlorosilane to provide an attached carbon content of 1.1 wt. %, and then mixed with 20 parts of dimethylsilicone oil ("KF-96 100cs", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 7.3 wt. % (that is, attachment of 6.2 wt. % carbon by treatment with the silicone oil).

Then, 1.0 part of the treated silica fine powder thus obtained and 100 parts of the magnetic toner of Example 20 were blended by a Henschel mixer to obtain a magnetic developer.

The magnetic developer was subjected to image formation tests in the same manner as in Example 17. The results are also shown in Table 9.

EXAMPLE 23

100 parts of silica fine powder ("Aerosil #300", mfd. by Nihon Aerosil K.K. ) was treated with 30 parts of dimethyldichlorosilane to provide an attached carbon content of 2.2 wt. %, and then mixed with 15 parts of α-methylstyrene-modified silicone oil ("KF-410", mfd. by Shin-Etsu Kagaku Kogyo K.K.) diluted with a solvent, followed by removal by evaporation under reduced pressure of the solvent and heating at 190° C., to provide a treated silica fine powder having an attached carbon content of 6.1 wt. % (that is, attachment of 3.9 wt. % carbon by treatment with the silicone oil).

Then, 1.0 part of the treated silica fine powder thus obtained and 100 parts of the magnetic toner of Example 20 were blended by a Henschel mixer to obtain a magnetic developer.

The magnetic developer was subjected to image formation tests in the same manner as in Example 17. The results are also shown in Table 9.

EXAMPLE 24

| | |
|---|---|
| Styrene/butylacrylate/divinylbenzene copolymer (wt. ratio = 80/19.5/0.5, Mw = $32 \times 10^4$) | 100 part(s) |
| Magnetic iron oxide of Prod. Ex. 2 | 60 part(s) |
| Monoazo dye Cr complex | 1 part(s) |
| Low-molecular weight polypropylene | 3 part(s) |

A magnetic toner having a weight-average particle size of 11.6 μm was prepared from the above ingredients in the same manner as in Example 17.

100 parts of the magnetic toner and 0.6 part of the treated silica fine powder of Example 18 were blended by a Henschel mixer to prepare a magnetic developer.

The magnetic developer was charged in a commercially available laser beam printer ("LBP-A404", mfd. by Canon K.K.) and subjected to image forming tests in the same manner as in Example 17. The results are shown in Table 9.

Comparative Example 8

A magnetic toner having a weight-average particle size of 6.5 μm was prepared in the same manner as in Example 17 except for using the magnetic iron oxide of Comparative Production Example 1.

100 parts of the magnetic toner and 1.0 part of the treated silica fine powder used in Example 18 (treated successively with dimethyldichlorosilane and dimethylsilicone oil) were blended by a Henschel mixer to obtain a magnetic developer.

The magnetic developer was subjected to image formation tests in the same manner as in Example 17. The results are also shown in Table 9.

Comparative Example 9

100 parts of silica fine powder ("Aerosil #200") was treated with 20 parts of dimethyldichlorosilane.

1.0 part of the thus obtained treated silica fine powder and 100 parts of the magnetic toner of Comparative Example 8 were blended by a Henschel mixer to obtain a magnetic developer.

The magnetic developer was subjected to image formation tests in the same manner as in Example 17. The results are also shown in Table 9.

Comparative Example 10

A magnetic toner having a weight-average particle size of 6.4 μm was prepared in the same manner as in Example 17 except for using the magnetic iron oxide of Comparative Production Example 2.

100 parts of the magnetic toner and 1.0 part of the treated silica fine powder used in Comparative Example 9 (treated with dimethyldichlorosilane) were blended by a Henschel mixer to obtain a magnetic developer.

The magnetic developer was subjected to image formation tests in the same manner as in Example 17. The results are also shown in Table 9.

TABLE 9*

| | Image density | | | | Dot reproducibility | Fog | Hollow image defect |
|---|---|---|---|---|---|---|---|
| | N.T.-N.H. | | | | N.T.-N.H. | L.T.-L.H. | H.T.-H.H. |
| | Initial stage | Final stage | L.T.-L.H. Final stage | H.T.-H.H. Final stage | after 3000 sheets | after 3000 sheets | after 3000 sheets |
| Ex. 17 | 1.47 | 1.45 | 1.46 | 1.41 | ∘ | 0.8% | ∘ |
| 18 | 1.46 | 1.46 | 1.45 | 1.39 | ∘ | 1.3% | ∘ |
| 19 | 1.45 | 1.44 | 1.44 | 1.39 | ∘ | 0.7% | ∘ |
| 20 | 1.46 | 1.45 | 1.45 | 1.40 | ∘ | 1.0% | ∘ |
| 21 | 1.46 | 1.45 | 1.44 | 1.35 | ∘ | 1.2% | ∘Δ |
| 22 | 1.46 | 1.45 | 1.45 | 1.40 | ∘ | 1.2% | ⊙ |
| 23 | 1.46 | 1.45 | 1.45 | 1.37 | ∘ | 1.4% | ∘ |
| 24 | 1.45 | 1.44 | 1.44 | 1.39 | ∘Δ | 0.7% | ∘ |
| Comp. Ex. 8 | 1.42 | 1.22 | 1.25 | 1.16 | x | 5.8% | ∘Δ |
| 9 | 1.30 | 1.05 | 1.12 | 1.01 | x | 6.0% | x |
| 10 | 1.32 | 1.02 | 1.08 | 1.03 | x | 6.6% | x |

*1) N.T.-N.H. = normal temperature-normal humidity (23.5° C.-60% RH)
H.T.-H.H. = high temperature-high humidity (32.5° C.-85% RH)
L.T.-L.H. = low temperature-low humidity (10° C.-15% RH)
2) Evaluation standards are the same as in Table 3 except for Hollow image defect which will be supplemented in the following page.
Hollow image defect
⊙: Very good
∘: Good
∘Δ: Slightly inferior but of no problem
Δ: Somewhat inferior
x: Poor.

EXAMPLE 25

| | |
|---|---|
| Styrene/butyl acrylate/divinylbenzene copolymer (copolymerization wt. ratio = 80/19.5/0.5, weight-average molecular weight (Mw) = 32 × $10^4$) | 100 part(s) |
| Magnetic iron oxide of Prod. Ex. 1 | 90 part(s) |
| Monoazo dye Cr complex | 0.8 part(s) |
| Low-molecular weight polypropylene | 3 part(s) |

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type wind-force classifier to obtain a classified powder product. Ultra-fine powder and coarse power were simultaneously removed from the classified powder by means of a multi-division classifier to obtain a negatively chargeable magnetic toner having a weight-average particle size of 6.6 μm.

Separately, 100 parts of silica fine powder ("Aerosil #200", mfd. by Nihon Aerosil K.K.) was treated with 20 parts of trimethylchlorosilane to provide a specific surface area of 160 $m^2/g$, and then mixed with 10 parts of dimethylsilicone oil ("KF-96 100cs", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 90 $m^2/g$ (i.e., 0.56 times that before the treatment with the silicone oil).

Then, 100 parts of the above-prepared magnetic toner and 1.0 part of the treated silica fine powder were blended by a Henschel mixer to obtain a magnetic developer.

Separately, a commercially available laser beam printer ("LBP-8II", mfd. by Canon K.K.) was remodeled to provide an increased printing speed of 16 sheets/min. from 8 sheets/min.

Then, the above-prepared magnetic developer was incorporated in the re-modeled laser beam printer and used for image formation in the same manner as in the previous Examples.

Thus, successive image formation was performed up to 8000 sheets in a normal temperature - normal humidity (23.5° C. - 60 %RH) environment.

Similarly as in the previous Examples, the images were evaluated with respect to an image density as measured by a MacBeth reflection densitometer, fog as measured by comparison between a fresh plain paper and a plain paper on which a solid white image was printed with respect to whiteness as measured by a reflection meter (mfd. by Tokyo Denshoku K.K.), and a dot reproducibility after image formation of a checker pattern shown in FIG. 7, and also a transfer failure (in an inner part of an image, i.e., a hollow image defect) during transfer onto a transparency film. The results are shown in Table 10 appearing hereinafter.

Similar image forming tests were performed in a high temperature - high humidity (32.5° C. - 85 %RH) environment and in a low temperature - low humidity (10° C. - 15 %RH) environment. The results are also shown in Table 10.

EXAMPLE 26

| | |
|---|---|
| Styrene/butyl acrylate/divinylbenzene copolymer (wt. ratio = 80/19.5/0.5, Mw = 32 × $10^4$) | 100 part(s) |
| Magnetic iron oxide of Prod. Ex. 2 | 100 part(s) |
| Monoazo dye Cr complex | 1 part(s) |
| Low-molecular weight polypropylene | 4 part(s) |

A magnetic toner having a weight-average particle size of 6.2 μm was prepared from the above ingredients otherwise in the same manner as in Example 25.

Separately, 100 parts of silica fine powder ("Aerosil #300", mfd. by Nihon Aerosil K.K.) was treated with 30 parts of dimethyldichlorosilane to provide specific surface area of 230 $m^2/g$, and then mixed with 15 parts of dimethylsilicone oil ("KF-96 100cs", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 120 $m^2/g$ (i.e., 0.52 times that before the treatment with the silicone oil).

Then, 100 parts of the above-prepared magnetic toner and 1.0 parts of the treated silica fine powder were blended by a Henschel mixer to obtain a magnetic developer.

The magnetic developer was used for image formation tests in the same manner as in Example 25. The results are also shown in Table 10.

EXAMPLE 27

| | |
|---|---|
| Styrene/butyl acrylate/divinylbenzene copolymer (wt. ratio = 80/19.5/0.5, Mw = $32 \times 10^4$) | 100 part(s) |
| Magnetic iron oxide of Prod. Ex. 3 | 80 part(s) |
| Monoazo dye Cr complex | 1 part(s) |
| Low-molecular weight polypropylene | 3 part(s) |

A magnetic toner having a weight-average particle size of 7.5 μm was prepared from the above ingredients in the same manner as in Example 25.

100 parts of the magnetic toner and 1.0 part of the treated silica fine powder of Example 26 were blended by a Henschel mixer to prepare a magnetic developer.

The magnetic developer was subjected to image forming tests in the same manner as in Example 25. The results are shown in Table 10.

Example 28

| | |
|---|---|
| Styrene/ethylhexyl acrylate/divinylbenzene copolymer (wt. ratio = 80/19.5/0.5; Mw = $32 \times 10^4$) | 100 part(s) |
| Magnetic iron oxide of Prod. Ex. 4 | 120 part(s) |
| Monoazo dye Cr complex | 4 part(s) |
| Low-molecular weight polypropylene | 4 part(s) |

A magnetic toner having a weight-average particle size of 5.2 μm was prepared from the above ingredients in the same manner as in Example 25.

Separately, 100 parts of silica fine powder ("Aerosil #200", mfd. by Nihon Aerosil K.K.) was treated with 20 parts of dimethyldichlorosilane to provide a specific surface area of 180 $m^2/g$, and then mixed with 15 parts of dimethylsilicone oil ("KF-96 100cs", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 100 $m^2/g$ (i.e., 0.56 times that before the treatment with the silicone oil).

Then, 100 parts of the above-prepared magnetic toner and 1.6 parts of the treated silica fine powder were blended by a Henschel mixer to obtain a magnetic developer.

The magnetic developer was used for image formation tests in the same manner as in Example 25. The results are also shown in Table 10.

EXAMPLE 29

| | |
|---|---|
| Styrene/butyl acrylate/divinylbenzene copolymer (wt. ratio = 80/19.5/0.5; Mw = $32 \times 10^4$) | 100 part(s) |
| Magnetic iron oxide of Prod. Ex. 1 | 80 part(s) |
| Monoazo dye Cr complex | 1 part(s) |

-continued

| | |
|---|---|
| Low-molecular weight polypropylene | 3 part(s) |

A magnetic toner having a weight-average particle size of 7.2 μm was prepared from the above ingredients in the same manner as in Example 25.

Separately, 100 parts of silica fine powder ("Aerosil #300", mfd. by Nihon Aerosil K.K.) was treated with 30 parts of dimethyldichlorosilane to provide a specific surface area of 230 $m^2/g$, and then mixed with 20 parts of dimethylsilicone oil ("KF-96 100cs", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 100 $m^2/g$ (i.e., 0.43 times that before the treatment with the silicone oil).

Then, 100 parts of the above-prepared magnetic toner and 0.8 part of the treated silica fine powder were blended by a Henschel mixer to obtain a magnetic developer.

The magnetic developer was used for image formation tests in the same manner as in Example 25. The results are also shown in Table 10.

EXAMPLE 30

100 parts of silica fine powder ("Aerosil #300", mfd. by Nihon Aerosil K.K.) was treated with 35 parts of dimethyldichlorosilane to provide a specific surface area of 210 $m^2/g$, and then mixed with 5 parts of dimethylsilicone oil ("KF-96 100cs", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 125 $m^2/g$ (i.e., 0.59 times that before the treatment with the silicone oil).

Then, 0.8 part of the treated silica fine powder thus obtained and 100 parts of the magnetic toner of Example 29 were blended by a Henschel mixer to obtain a magnetic developer.

The magnetic developer was subjected to image formation tests in the same manner as in Example 25. The results are also shown in Table 10.

EXAMPLE 31

100 parts of silica fine powder ("Aerosil #200", mfd. by Nihon Aerosil K.K.) was treated with 20 parts of trimethylchlorosilane to provide a specific surface area of 160 $m^2/g$, and then mixed with 15 parts of α-methylstyrene-modified silicone oil ("KF-410", mfd. by Shin-Etsu Kagaku Kogyo K.K.) diluted with a solvent, followed by removal by evaporation under reduced pressure of the solvent and heating at 150° C., to provide a treated silica fine powder having a specific surface area of 80 $m^2/g$ (i.e., 0.50 times that before the treatment with the silicone oil).

Then, 0.8 part of the treated silica fine powder thus obtained and 100 parts of the magnetic toner of Example 29 were blended by a Henschel mixer to obtain a magnetic developer.

The magnetic developer was subjected to image formation tests in the same manner as in Example 25 . The results are also shown in Table 10.

EXAMPLE 32

| | |
|---|---|
| Styrene/butylacrylate/divinylbenzene copolymer (wt. ratio = 80/19.5/0.5, Mw = 32 × $10^4$) | 100 part(s) |
| Magnetic iron oxide of Prod. Ex. 2 | 60 part(s) |
| Monoazo dye Cr complex | 2 part(s) |
| Low-molecular weight polypropylene | 3 part(s) |

A magnetic toner having a weight-average particle size of 11.8 μm was prepared from the above ingredients in the same manner as in Example 25.

100 parts of the magnetic toner and 0.6 part of the treated silica fine powder of Example 26 were blended by a Henschel mixer to prepare a magnetic developer.

The magnetic developer was charged in a commercially available laser beam printer ("LBP-A404", mfd. by Canon K.K.) and subjected to image forming tests in the same manner as in Example 25. The results are shown in Table 10.

Comparative Example 11

A magnetic toner having a weight-average particle size of 6.8 μm was prepared in the same manner as in Example 25 except for using the magnetic iron oxide of Comparative Production Example 1.

100 parts of the magnetic toner and 1.0 part of the treated silica fine powder used in Example 25 (treated successively with trimethylchlorosilane and dimethylsilicone oil) were blended by a Henschel mixer to obtain a magnetic developer.

The magnetic developer was subjected to image formation tests in the same manner as in Example 25. The results are also shown in Table 10.

Comparative Example 12

100 parts of silica fine powder ("Aerosil #200") was treated with 20 parts of dimethyldichlorosilane.

1.0 part of the thus obtained treated silica fine powder and 100 parts of the magnetic toner of Comparative Example 11 were blended by a Henschel mixer to obtain a magnetic developer.

The magnetic developer was subjected to Image formation tests in the same manner as in Example 25. The results are also shown in Table 10.

Comparative Example 13

A magnetic toner having a weight-average particle size of 6.7 μm was prepared in the same manner as in Example 25 except for using the magnetic iron oxide of Comparative Production Example 2.

100 parts of the magnetic toner and 1.0 part of the treated silica fine powder used in Comparative Example 12 (treated with dimethyldichlorosilane) were blended by a Henschel mixer to obtain a magnetic developer.

The magnetic developer was subjected to image formation tests in the same manner as in Example 25. The results are also shown in Table 10.

TABLE 10*

| | Image density | | | | Dot reproducibility | Fog | Hollow image defect |
|---|---|---|---|---|---|---|---|
| | N.T.-N.H. | | | | N.T.-N.H. | L.T.-L.H. | H.T.-H.H. |
| | Initial stage | Final stage | L.T.-L.H. Final stage | H.T.-H.H. Final stage | after 3000 sheets | after 3000 sheets | after 3000 sheets |
| Ex. 25 | 1.46 | 1.45 | 1.45 | 1.40 | ○ | 0.9% | ○ |
| 26 | 1.43 | 1.42 | 1.44 | 1.39 | ○ | 1.1% | ○ |
| 27 | 1.46 | 1.45 | 1.44 | 1.38 | ○ | 0.9% | ○ |
| 28 | 1.45 | 1.46 | 1.46 | 1.39 | ○ | 1.5% | ○ |
| 29 | 1.46 | 1.45 | 1.45 | 1.41 | ○ | 1.2% | ○ |
| 30 | 1.46 | 1.45 | 1.45 | 1.35 | ○ | 1.0% | ○ |
| 31 | 1.46 | 1.45 | 1.45 | 1.38 | ○ | 1.3% | ○ |
| 32 | 1.46 | 1.45 | 1.45 | 1.39 | ○ | 0.6% | ○ |
| Comp. Ex. 11 | 1.41 | 1.20 | 1.25 | 1.18 | x | 5.9% | ○ |
| 12 | 1.30 | 1.05 | 1.12 | 1.01 | x | 6.0% | x |
| 13 | 1.32 | 1.02 | 1.08 | 1.03 | x | 6.6% | x |

*1) N.T.-N.H. = normal temperature-normal humidity (23.5° C.-60% RH)
H.T.-H.H. = high temperature-high humidity (32.5° C.-85% RH)
L.T.-L.H. = low temperature-low humidity (10° C.-15% RH)
2) Evaluation standards are the same as in Table 9.

As described above, according to the present invention, the environmental stability and developing performances of a magnetic toner rich in fine particles characterized by a weight-average particle size of at most 13.5 μm and at most 50 wt. % of magnetic toner particles of 12.7 μm or larger, can be improved by incorporating a magnetic iron oxide having a characteristic silicon (Si) distribution and mixing the magnetic toner particles with resin fine particles having an average particle size of 0.03–2.0 μm and a chargeability of the same polarity as the magnetic toner.

If the magnetic toner are regulated to have a more restricted particle size distribution as represented by a weight-average particle size of 6–8 μm and a more precisely defined amount of particles of 5 μm or smaller, the magnetic toner can show further improved characteristics, such as high resolution, high density, less fog or scattering, and excellent successive image formation characteristic.

Further, if the magnetic toner is blended with a hydrophobic inorganic fine powder specifically treated with silicone oil or varnish, the resultant magnetic developer is provided with further improved environmental stability and developing characteristics.

What is claimed is:

1. A magnetic toner, comprising a binder resin and a silicon-containing magnetic iron oxide;

wherein the magnetic iron oxide contains 0.5–4 wt. % silicon based on total iron content, provided that the magnetic iron oxide has a total silicon content (A), a silicon content (B) attributable to siliceous compound contained in a surface layer of the magnetic iron oxide particles and dissolved up to 20 wt. % iron dissolution by hydrochloric acid solution or a mixture of hydrochloric acid solution and hydrofluoric acid solution and a superficial silicon content (C), attributable to siliceous compound contained in a surface layer of the magnetic iron oxide particles and dissolved by an alkali solution, satisfying relations of $44\% \leqq (B/A) \times 100\ \% \leqq 84\%$ and $10\% \leqq (C/A) \times 100\% \leqq 55\%$; and the magnetic toner has a weight-average particle size of at most 13.5 μm and has a particle size distribution such that it contains no more than 50 wt. % of magnetic toner particles having a particle size of at least 12.7 μm.

2. The magnetic toner according to claim 1, wherein the magnetic iron oxide contains 0.8–3.0 wt. % silicon based on total iron content.

3. The magnetic toner according to claim 1, wherein the magnetic iron oxide contains 0.9–3.0 wt. % silicon based on total iron content.

4. The magnetic toner according to claim 1, wherein the magnetic iron oxide satisfies a relation of $60\% \leqq (B/A) \times 100\% \leqq 80\%$.

5. The magnetic toner according to claim 1, wherein the magnetic iron oxide satisfies a relation of $25\% \leqq (C/A) \times 100\% \leqq 40\%$.

6. The magnetic toner according to claim 1, wherein the magnetic iron oxide contains 0.8–3.0 wt. % silicon based on total iron content and satisfy relations of $60\% \leqq (B/A) \times 100\% \leqq 80\%$ and $25\% \leqq (C/A) \times 100\% \leqq 40\%$.

7. The magnetic toner according to claim 6, wherein the magnetic iron oxide contains 0.9–3.0 wt. % silicon based on total iron content.

8. The magnetic toner according to claim 1, wherein the magnetic iron oxide has an average particle size of 0.1–0.4 μm.

9. The magnetic toner according to claim 1, wherein the magnetic iron oxide has an average particle size of 0.1–0.3 μm.

10. The magnetic toner according to claim 1, wherein the magnetic iron oxide has a triboelectric chargeability of −25 to −70 μC/g.

11. The magnetic toner according to claim 1, wherein the magnetic iron oxide has a triboelectric chargeability of −40 to −60 μC/g.

12. The magnetic toner according to claim 1, wherein the magnetic iron oxide has a volume resistivity of $5 \times 10^3 - 1 \times 10^8$ Ω.cm.

13. The magnetic toner according to claim 1, wherein the magnetic iron oxide has a volume resistivity of $5 \times 10^4 - 5 \times 10^7$ Ω.cm.

14. The magnetic toner according to claim 1, wherein the magnetic iron oxide has an agglomeration degree of 3–40%.

15. The magnetic toner according to claim 1, wherein the magnetic iron oxide has an agglomeration degree of 5–30%.

16. The magnetic toner according to claim 1, wherein the magnetic iron oxide has a smoothness D of 0.2–0.6.

17. The magnetic toner according to claim 1, wherein the magnetic iron oxide has a smoothness D of 0.3–0.5.

18. The magnetic toner according to claim 1, wherein the magnetic iron oxide has a sphericity $\phi$ of at least 0.8.

19. The magnetic toner according to claim 1, wherein the magnetic iron oxide has a sphericity $\phi$ of at least 0.85.

20. The magnetic toner according to claim 1, wherein the magnetic iron oxide has a sphericity $\phi$ of at least 0.9.

21. The magnetic toner according to claim 1, wherein the magnetic toner has a weight-average particle size of 3.5–13.5 μm.

22. The magnetic toner according to claim 1, wherein the magnetic toner has a weight-average particle size of 5.0–13.0 μm.

23. The magnetic toner according to claim 1, wherein the magnetic toner has a weight-average particle size of 3.5–13.5 μm and contains at most 40 wt. % of magnetic toner particles having a particle size of at least 12.7 μm.

24. The magnetic toner according to claim 1, wherein the magnetic toner has a weight-average particle size of 5.0–13.0 μm and contains at most 40 wt. % of magnetic toner particles having a particle size of at least 12.7 μm.

25. The magnetic toner according to claim 1, wherein the magnetic toner has a weight-average particle size of 6–8 μm and has a particle size distribution such that it contains 17–60 % by number of toner particles having a particle size of at most 5 μm, 5–50% by number of toner particles having a particle size of 6.35–10.08 μm and at most 2.0% by volume of toner particles having a particle size of at least 12.7 82 m, and the amount of the toner particles having a particle size of at most 5 μm in terms of % by number (N %) and % by volume (V %) satisfy a relationship of $N/V = -0.05N + k$, wherein k is a positive number of 4.6 to 6.7, and N is a positive number of 17–60.

26. The magnetic toner according to claim 1, wherein 20–200 wt. parts of the magnetic iron oxide is contained per 100 wt. parts of the binder resin.

27. The magnetic toner according to claim 1, wherein 30–150 wt. parts of the magnetic iron oxide is contained per 100 wt. parts of the binder resin.

28. The magnetic toner according to claim 1, wherein the binder resin comprises a styrene copolymer.

29. The magnetic toner according to claim 1, wherein the binder resin comprises a polyester resin.

30. A magnetic developer, comprising: a magnetic toner, and inorganic fine powder, hydrophobic inorganic fine powder or resin fine particles;

wherein the magnetic toner comprises a binder resin and a silicon-containing magnetic iron oxide;

the magnetic iron oxide contains 0.5–4 wt. % silicon based on total iron content, provided that the magnetic iron oxide has a total silicon content (A), a silicon content (B), attributable to siliceous compound contained in a surface layer of the magnetic iron oxide particles and dissolved up to 20 wt. % iron dissolution by hydrochloric acid solution or a mixture of hydrochloric acid solution and hydrofluoric acid solution and a superficial silicon content (C), attributable to siliceous compound contained in a surface layer of the magnetic iron oxide particles and dissolved by an alkali solution, satisfying relations of $44\% \leqq (B/A) \times 100\% \leqq 84\%$ and $10\% \leqq (C/A) \times 100\% \leqq 55\%$; and the magnetic toner has a weight-average particle size of at most 13.5 μm and has a particle size distribution such that it contains no more than 50 wt. % of magnetic toner particles having a particle size of at least 12.7 μm.

31. The magnetic developer according to claim 30, wherein said hydrophobic inorganic fine powder comprises hydrophobic silica fine powder.

32. The magnetic developer according to claim 31, wherein 0.1–5 wt. parts of the hydrophobic silica fine powder is mixed with 100 wt. parts of the magnetic toner.

33. The magnetic developer according to claim 31, wherein 0.1–3 wt. parts of the hydrophobic silica fine powder is mixed with 100 wt. parts of the magnetic toner.

34. The magnetic developer according to claim 30, wherein said resin fine particles has a chargeability of a polarity which is identical in polarity to a negative chargeability or a positive chargeability of the magnetic toner.

35. The magnetic developer according to claim 34, wherein the resin fine particles have an average particle size of 0.03–2.0 μm.

36. The magnetic developer according to claim 30, wherein 0.1–5 wt. parts of the inorganic fine powder is mixed with 100 wt. parts of the magnetic toner.

37. The magnetic developer according to claim 30, wherein 0.1–3 wt. parts of the inorganic fine powder is mixed with 100 wt. parts oi the magnetic toner.

38. The magnetic developer according to claim 30, wherein the magnetic iron oxide contains 0.8–3.0 wt. % silicon based on total iron content.

39. The magnetic developer according to claim 30, wherein the magnetic iron oxide contains 0.9–3.0 wt. % silicon based on total iron content.

40. The magnetic developer according to claim 30, wherein the magnetic iron oxide satisfies a relation of $60\% \leqq (B/A) \times 100\% \leqq 80\%$.

41. The magnetic developer according to claim 30, wherein the magnetic iron oxide satisfies a relation of $25\% \leqq (C/A) \times 100\% \leqq 40\%$.

42. The magnetic developer according to claim 30, wherein the magnetic iron oxide contains 0.8–3.0 wt. % silicon based on total iron content and satisfy relations of $60\% \leqq (B/A) \times 100\% \leqq 80\%$ and $25\% \leqq (C/A) \times 100\% \leqq 40\%$.

43. The magnetic developer according to claim 42, wherein the magnetic iron oxide contains 0.9–3.0 wt. % silicon based on total iron content.

44. The magnetic developer according to claim 30, wherein the magnetic iron oxide has an average particle size of 0.1–0.4 μm.

45. The magnetic developer according to claim 30, wherein the magnetic iron oxide has an average particle size of 0.1–0.3 μm.

46. The magnetic developer according to claim 30, wherein the magnetic iron oxide has a triboelectric chargeability of −25 to −70 μC/g.

47. The magnetic developer according to claim 30, wherein the magnetic iron oxide has a triboelectric chargeability of −40 to −60 μC/g.

48. The magnetic developer according to claim 30, wherein the magnetic iron oxide has a volume resistivity of $5 \times 10^3 - 1 \times 10^8$ Ω.cm.

49. The magnetic developer according to claim 30, wherein the magnetic iron oxide has a volume resistivity of $5 \times 10^4 - 5 \times 10^7$ Ω.cm.

50. The magnetic developer according to claim 30, wherein the magnetic iron oxide has an agglomeration degree of 3–40%.

51. The magnetic developer according to claim 30, wherein the magnetic iron oxide has an agglomeration degree of 5–30%.

52. The magnetic developer according to claim 30, wherein the magnetic iron oxide has a smoothness D of 0.2–0.6.

53. The magnetic developer according to claim 30, wherein the magnetic iron oxide has a smoothness D of 0.3–0.5.

54. The magnetic developer according to claim 30, wherein the magnetic iron oxide has a sphericity $\phi$ of at least 0.8.

55. The magnetic developer according to claim 30, wherein the magnetic iron oxide has a sphericity $\phi$ of at least 0.85.

56. The magnetic developer according to claim 30, wherein the magnetic iron oxide has a sphericity $\phi$ of at least 0.9.

57. The magnetic developer according to claim 30, wherein the magnetic toner has a weight-average particle size of 3.5–13.5 μm.

58. The magnetic developer according to claim 30, wherein the magnetic toner has a weight-average particle size of 5.0–13.0 μm.

59. The magnetic developer according to claim 30, wherein the magnetic toner has a weight-average particle size of 3.5–13.5 μm and contains at most 40 wt. % of magnetic toner particles having a particle size of at least 12.7 μm.

60. The magnetic developer according to claim 30, wherein the magnetic toner has a weight-average particle size of 5.0–13.0 μm and contains at most 40 wt. % of magnetic toner particles having a particle size of at least 12.7 μm.

61. The magnetic developer according to claim 30, wherein the magnetic toner has a weight-average particle size of 6–8 μm and has a particle size distribution such that it contains 17–60% by number of toner particles having a particle size of at most 5 μm, 5–50% by number of toner particles having a particle size of 6.35–10.08 μm and at most 2.0% by volume of toner particles having a particle size of at least 12.7 μm, and the amount of the toner particles having a particle size of at most 5 μm in terms of % by number (N %) and % by volume (V %) satisfy a relationship of $N/V = -0.05N + k$, wherein k is a positive number of 4.6 to 6.7, and N is a positive number of 17–60.

62. The magnetic developer according to claim 30, wherein 20–200 wt. parts of the magnetic iron oxide is contained per 100 wt. parts of the binder resin.

63. The magnetic developer according to claim 30, wherein 30–150 wt. parts of the magnetic iron oxide is contained per 100 wt. parts of the binder resin.

64. The magnetic developer according to claim 30, wherein the binder resin comprises a styrene copolymer.

65. The magnetic developer according to claim 30, wherein the binder resin comprises a polyester resin.

66. An apparatus unit, comprising:

a latent image-bearing member for bearing a latent image thereon and a developing apparatus for developing the latent image; the developing apparatus including a developer container for containing a developer, a developer-carrying member for carrying and conveying the developer from the developer container to a developing zone facing the latent image-bearing member, and a regulating blade for regulating the developer carried and conveyed by the developer-carrying membe4r into a prescribed thickness to form a thin layer of the developer on the developer carrying member;

wherein the developer comprising a magnetic toner comprising a binder resin and a magnetic iron oxide;

the magnetic iron oxide contains 0.5–4 wt. % silicon based on total iron content, provided that the magnetic iron oxide has a total silicon content (A), a silicon content (B), attributable to siliceous compound contained in a surface layer of the magnetic iron oxide particles and dissolved up to 20 wt. % iron dissolution by hydrochloric acid solution or a mixture of hydrochloric acid solution and hydrofluoric acid solution and a superficial silicon content (C), attributable to siliceous compound contained in a surface layer of the magnetic iron oxide particles and dissolved by an alkali solution, satisfying relations of $44\% \leqq (B/A) \times 100\% \leqq 84\%$ and $10\% \leqq (C/A) \times 100\% \leqq 55\%$; and the magnetic toner has a weight-average particle size of at most 13.5 μm and has a particle size distribution such that it contains no more than 50 wt. % of magnetic toner particles having a particle size of at least 12.7 μm.

67. An image forming apparatus, comprising:

a latent image-bearing member for bearing a latent image thereon and a developing apparatus for developing the latent image; the developing apparatus including a developer container for containing a developer, and a developer-carrying member for carrying and conveying the developer from the developer container to a developing zone facing the latent image-bearing member;

wherein the developer comprises a magnetic toner comprising a binder resin and a magnetic iron oxide;

the magnetic iron oxide contains 0.5–4 wt. % silicon based on total iron content, provided that the magnetic iron oxide has a total silicon content (A), a silicon content (B), attributable to siliceous compound contained in a surface layer of the magnetic iron oxide particles and dissolved up to 20 wt. % iron dissolution by hydrochloric acid solution or a mixture of hydrochloric acid solution and hydrofluoric acid solution and a superficial silicon content (C), attributable to siliceous compound contained in a surface layer of the magnetic iron oxide particles and dissolved by an alkali solution, satisfying relations of $44\% \leqq (B/A) \times 100\% \leqq 84\%$ and $10\% \leqq (C/A) \times 100\% \leqq 55\%$; and the magnetic toner has a weight-average particle size of at most 13.5 μm and has a particle size distribution such that it contains no more than 50 wt. % of magnetic toner particles having a particle size of at least 12.7 μm.

68. A facsimile apparatus, comprising:

an electrophotographic apparatus and a receiving means for receiving image data from a remote terminal;

wherein said electrophotographic apparatus comprises a latent image-bearing member for bearing a latent image thereon and a developing apparatus for developing the latent image; the developing apparatus including a developer container for containing a developer, a developer-carrying member for carrying and conveying the developer from the developer container to a developing zone facing the latent image-bearing member, and a regulating blade for regulating the developer carried and conveyed by the developer-carrying member into a prescribed thickness to form a thin layer of the developer on the developer carrying member;

wherein the developer comprises a magnetic toner comprising a binder resin and a magnetic iron oxide;

the magnetic iron oxide contains 0.5–4 wt. % silicon based on total iron content, provided that the magnetic iron oxide has a total silicon content (A), a silicon content (B), attributable to siliceous compound contained in a surface layer of the magnetic iron oxide particles and dissolved up to 20 wt. % iron dissolution by hydrochloric acid solution or a mixture of hydrochloric acid solution and hydrofluoric acid solution and a superficial silicon content (C), attributable to siliceous compound contained in a surface layer of the magnetic iron oxide particles and dissolved by an alkali solution, satisfying relations of $44\% \leqq (B/A) \times 100\% \leqq 84\%$ and $10\% \leqq (C/A) \times 100\% \leqq 55\%$; and the magnetic toner has a weight-average particle size of at most 13.5 μm and has a particle size distribution such that it contains no more than 50 wt. % of magnetic toner particles having a particle size of at least 12.7 μm.

69. The magnetic toner according to claims 66, 67 or 68 wherein the magnetic iron oxide contains 0.8–3.0 wt. % silicon based on total iron content.

70. The magnetic toner according to claims 66, 67 or 68 wherein the magnetic iron oxide contains 0.9–3.0 wt. % silicon based on total iron content.

71. The magnetic toner according to claims 66, 67 or 68 wherein the magnetic iron oxide satisfies a relation of $60\% \leqq (B/A) \times 100\% \leqq 80\%$.

72. The magnetic toner according to claims 66, 67 or 68 wherein the magnetic iron oxide satisfies a relation of $25\% \leqq (C/A) \times 100\% \leqq 40\%$.

73. The magnetic toner according to claims 66, 67 or 68 wherein the magnetic iron oxide contains 0.8–3.0 wt. % silicon based on total iron content and satisfy relations of $60\% \leqq (B/A) \times 100\% \leqq 80\%$ and $25\% \leqq (C/A) \times 100\% \leqq 40\%$.

74. The magnetic toner according to claim 71, wherein the magnetic iron oxide contains 0.9–3.0 wt. % silicon based on total iron content.

75. The magnetic toner according to claims 66, 67 or 68 wherein the magnetic iron oxide has an average particle size of 0.1–0.4 μm.

76. The magnetic toner according to claims 66, 67 or 68 wherein the magnetic iron oxide has an average particle size of 0.1–0.3 μm.

77. The magnetic toner according to claims 66, 67 or 68 wherein the magnetic iron oxide has a triboelectric chargeability of −25 to −70 μC/g.

78. The magnetic toner according to claims 66, 67 or 68 wherein the magnetic iron oxide has a triboelectric chargeability of −40 to −60 μC/g.

79. The magnetic toner according to claims 66, 67 or 68 wherein the magnetic iron oxide has a volume resistivity of $5 \times 10^3 - 1 \times 10^8$ Ω.cm.

80. The magnetic toner according to claims 66, 67 or 68 wherein the magnetic iron oxide has a volume resistivity of $5 \times 10^4 - 5 \times 10^7$ Ω.cm.

81. The magnetic toner according to claims 66, 67 or 68 wherein the magnetic iron oxide has an agglomeration degree of 3–40%.

82. The magnetic toner according to claims 66, 67 or 68 wherein the magnetic iron oxide has an agglomeration degree of 5–30%.

83. The magnetic toner according to claims 66, 67 or 68 wherein the magnetic iron oxide has a smoothness D of 0.2–0.6.

84. The magnetic toner according to claims 66, 67 or 68 wherein the magnetic iron oxide has a smoothness D of 0.3–0.5.

85. The magnetic toner according to claims 66, 67 or 68 wherein the magnetic iron oxide has a sphericity $\phi$ of at least 0.8.

86. The magnetic toner according to claims 66, 67 or 68 wherein the magnetic iron oxide has a sphericity $\phi$ of at least 0.85.

87. The magnetic toner according to claims 66, 67 or 68 wherein the magnetic iron oxide has a sphericity $\phi$ of at least 0.9.

88. The magnetic toner according to claims 66, 67 or 68 wherein the magnetic toner has a weight-average particle size of 3.5–13.5 μm.

89. The magnetic toner according to claims 66, 67 or 68 wherein the magnetic toner has a weight-average particle size of 5.0–13.0 μm.

90. The magnetic toner according to claims 66, 67 or 68 wherein the magnetic toner has a weight-average particle size of 3.5–13.5 μm and contains at most 40 wt. % of magnetic toner particles having a particle size of at least 12.7 μm.

91. The magnetic toner according to claims 66, 67 or 68 wherein the magnetic toner has a weight-average particle size of 5.0–13.0 μm and contains at most 40 wt. % of magnetic toner particles having a particle size of at least 12.7 μm.

92. The magnetic toner according to claims 66, 67 or 68 wherein the magnetic toner has a weight-average particle size of 6–8 μm and has a particle size distribution such that it contains 17–60% by number of toner particles having a particle size of at most 5 μm, 5–50% by number of toner particles having a particle size of 6.35–10.08 μm and at most 2.0% by volume of toner particles having a particle size of at least 12.7 μm, and the amount of the toner particles having a particle size of at most 5 μm in terms of % by number (N %) and % by volume (V %) satisfy a relationship of $N/V = -0.05 N + k$, wherein k is a positive number of 4.6 to 6.7, and N is a positive number of 17–60.

93. The magnetic toner according to claims 66, 67 or 68 wherein 20–200 wt. parts of the magnetic iron oxide is contained per 100 wt. parts of the binder resin.

94. The magnetic toner according to claims 66, 67 or 68 wherein 30–150 wt. parts of the magnetic iron oxide is contained per 100 wt. parts of the binder resin.

95. The magnetic toner according to claims 66, 67 or 68 wherein the binder resin comprises a styrene copolymer.

96. The magnetic toner according to claims 66, 67 or 68 wherein the binder resin comprises a polyester resin.

97. The magnetic developer according to claims 66, 67 or 68 which additionally includes an inorganic fine powder, hydrophobic inorganic fine powder or resin fine particles.

98. The magnetic developer according to claim 97 wherein said hydrophobic inorganic fine powder comprises hydrophobic silica fine powder.

99. The magnetic developer according to claim 98 wherein 0.1–5 wt. % parts of the hydrophobic silica fine powder is mixed with 100 wt. parts of the magnetic toner.

100. The magnetic developer according to claim 98 wherein 0.1–3 wt. % parts of the hydrophobic silica fine powder is mixed with 100 wt. parts of the magnetic toner.

101. The magnetic developer according to claim 97 wherein said resin fine particles have a chargeability of a polarity which is identical in polarity to a negative chargeability or a positive chargeability of the magnetic toner.

102. The magnetic developer according to claim 101 wherein the resin fine particles have an average particle size of 0.03–2.0 μm.

103. The magnetic developer according to claim 97 wherein 0.1–5 wt. parts of the inorganic fine powder is mixed with 100 wt. parts of the magnetic toner.

104. The magnetic developer according to claim 97 wherein 0.1–3 wt. parts of the inorganic fine powder is mixed with 100 wt. parts of the magnetic toner.

105. The magnetic developer according to claim 97 wherein the magnetic iron oxide contains 0.8–3.0 wt. % silicon based on total iron content.

106. The magnetic developer according to claim 97 wherein the magnetic iron oxide contains 0.9–3.0 wt. % silicon based on total iron content.

107. The magnetic developer according to claim 97 wherein the magnetic iron oxide satisfies a relation of $60\% \leqq (B/A) \times 100\% \leqq 80\%$.

108. The magnetic developer according to claim 97 wherein the magnetic iron oxide satisfies a relation of $25\% \leqq (C/A) \times 100\% \leqq 40\%$.

109. The magnetic developer according to claim 97 wherein the magnetic iron oxide contains 0.8–3.0 wt. % silicon based on total iron content and satisfy relations of $60\% \leqq (B/A) \times 100\% \leqq 80\%$ and $25\% \leqq (C/A) \times 100\% \leqq 40\%$.

110. The magnetic developer according to claim 109 wherein the magnetic iron oxide contains 0.9–3.0 wt. % silicon based on total iron content.

111. The magnetic developer according to claim 97 wherein the magnetic iron oxide has an average particle size of 0.1–0.4 μm.

112. The magnetic developer according to claim 95 wherein the magnetic iron oxide has an average particle size of 0.1–0.3 μm.

113. The magnetic developer according to claim 95 wherein the magnetic iron oxide has a triboelectric chargeability of −25 to −70 μC/g.

114. The magnetic developer according to claim 97 wherein the magnetic iron oxide has a triboelectric chargeability of −40 to −60 μC/g.

115. The magnetic developer according to claim 97 wherein the magnetic iron oxide has a volume resistivity of $5 \times 10^3 - 1 \times 10^8$ Ω.cm.

116. The magnetic developer according to claim 97 wherein the magnetic iron oxide has a volume resistivity of $5 \times 10^4 - 5 \times 10^7$ Ω.cm.

117. The magnetic developer according to claim 97 wherein the magnetic iron oxide has an agglomeration degree of 3–40%.

118. The magnetic developer according to claim 95 wherein the magnetic iron oxide has an agglomeration degree of 5–30%.

119. The magnetic developer according to claim 97 wherein the magnetic iron oxide has a smoothness D of 0.2–0.6.

120. The magnetic developer according to claim 97 wherein the magnetic iron oxide has a smoothness D of 0.3–0.5.

121. The magnetic developer according to claim 97 wherein the magnetic iron oxide has a sphericity $\phi$ of at least 0.8.

122. The magnetic developer according to claim 97 wherein the magnetic iron oxide has a sphericity $\phi$ of at least 0.85.

123. The magnetic developer according to claim 97 wherein the magnetic iron oxide has a sphericity $\phi$ of at least 0.9.

124. The magnetic developer according to claim 97 wherein the magnetic toner has a weight-average particle size of 3.5–13.5 μm.

125. The magnetic developer according to claim 97 wherein the magnetic toner has a weight-average particle size of 5.0–13.0 μm.

126. The magnetic developer according to claim 97 wherein the magnetic toner has a weight-average particle size of 3.5–13.5 μm and contains at most 40 wt. % of magnetic toner particles having a particle size of at least 12.7 μm.

127. The magnetic developer according to claim 97 wherein the magnetic toner has a weight-average particle size of 5.0–13.0 μm and contains at most 40 wt. % of magnetic toner particles having a particle size of at least 12.7 μm.

128. The magnetic toner according to claim 98, wherein the magnetic toner has a weight-average particle size of 6–8 μm and has a particle size distribution such that it contains 17–60% by number of toner particles having a particle size of at most 5 μm, 5–50% by number of toner particles having a particle size of 6.35–10.08 μm and at most 2.0% by volume of toner particles having a particle size of at least 12.7 μm, and the amount of the toner particles having a particle size of at most 5 μm in terms of % by number (N %) and % by volume (V %) satisfy a relationship of $N/V=0.05N+k$, wherein k is a positive number of 4.6 to 6.7, and N is a positive number of 17–60.

129. The magnetic developer according to claim 97 wherein 20–200 wt. parts of the magnetic iron oxide is contained per 100 wt. parts of the binder resin.

130. The magnetic developer according to claim 97 wherein 30–150 wt. parts of the magnetic iron oxide is contained per 100 wt. parts of the binder resin.

131. The magnetic developer according to claim 97 wherein the binder resin comprises a styrene copolymer.

132. The magnetic developer according to claim 95 wherein the binder resin comprises a polyester resin.

* * * * *

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

ON TITLE PAGE

In [57] ABSTRACT:
Line 4, "o" should read --of--.
Line 5, "o" should read --no--.

COLUMN 2

Line 12, "number" should read --amount--.
Line 40, "account" should read --amount--.

COLUMN 4

Line 24, "of" should read --or--.
Line 55, "and" should be deleted.

COLUMN 7

Line 26, "occupies" should read --occupy-- and "contains" should read --contain--.

COLUMN 9

Line 23, "caused to" should read --caused to adhere to--.

COLUMN 12

Line 61, "6.35 10.08 μm" should read --6.35 - 10.08 μm--.

COLUMN 13

Line 49, "5-50" should read --5-50%--.

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

COLUMN 14

Line 51, "worse" should read --worse,--.

COLUMN 16

Line 50, "hydrophObicity-imparting" should read --hydrophobicity-imparting--.
Line 63, "dimethyldichlorisilane," should read --dimethyldichlorosilane,--.
Line 66, "bromomethyldimethyl-chlorosilane," should read --bromomethyldimethylchlorosilane,--.
Line 67, "ß-chloro-ethyltrichlorosilane," should read --ß-chloroethyltrichlorosilane,--.
Line 68, "thyldimethylchloro-silane," should read --thyldimethylchlorosilane,--.

COLUMN 17

Line 2, "dimethyl-acetoxysilane," should read --dimethylacetoxysilane,--.
Line 4, "1,3-divinyltetramethyl-disiloxane," should read --1,3-divinyltetramethyldisiloxane,--.
Line 9, "dimethyl-silicone" should read --dimethylsilicone--.
Line 10, α-methyl-styrene-modified" should read --α-methylstyrene-modified--.

COLUMN 18

Line 46, "attained moisture" should read --attained. Moisture--.

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

COLUMN 19

Line 22, "γ-methaceryloxy-" should read --γ-methacryloxy- --.
Line 63, "pot" should read --bottle--.

COLUMN 21

Line 36, "(30-300 μ)" should read --(30-300 μm)--.

COLUMN 22

Line 10, "member," should read --members,--.
Line 64, "steel:" should read --steel;--.

COLUMN 23

Line 2, "bead 9" should read --blade 9--.

COLUMN 25

TABLE 2, "(uc/g)" should read --μC/g--.

COLUMN 26

TABLE 2, "surface" (second occurrence) should read --Surface--.

COLUMN 29

Line 27, "14 μpm" should read --14 μm--.

COLUMN 33

TABLE 4, "(μc/g)" should read --μC/g--.

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

COLUMN 34

Line 64, "(15°C. 10%RH)." should read --(15°C.-10% RH).--.

COLUMN 35

Line 4, "1000-999" should read --1000-1999--.

COLUMN 45

Line 66, "Image" should read --image--.

COLUMN 46

Line 46, "are" should read --is--.

COLUMN 47

Line 27, "satisfy" should read --satisfies--.

COLUMN 48

Line 22, "12.7 83 m," should read --12.7 μm,--.

COLUMN 49

Line 6, "has" should read --have--.
Line 14, "is" should read --are--.
Line 18, "oi" should read --of--.
Line 33, "satisfy" should read --satisfies--.

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

COLUMN 50

Line 40, "is" should read --are--.
Line 60, "membe4r" should read --member--.
Line 63, "comprising" should read --comprises--.

COLUMN 52

Line 35, "satisfy" should read --satisfies--.
Line 38, "claim 71," should read --claim 73,--.

COLUMN 53

Line 63, "is" should read --are--.
Line 67, "is" should read --are--.

COLUMN 54

Line 10, "is" should read --are--.
Line 13, "is" should read --are--.
Line 29, "satisfy" should read --satisfies--.
Line 38, "claim 95" should read --claim 97--.
Line 41, "claim 95" should read --claim 97--.

UNITED STATES PATENT AND TRADEMARK OFFICE

CERTIFICATE OF CORRECTION

PATENT NO. : 5,424,810

DATED : June 13, 1995

INVENTOR(S) : KOICHI TOMIYAMA, ET AL.

It is certified that error appears in the above-identified patent and that said Letters Patent is hereby corrected as shown below:

COLUMN 54

Line 57, "claim 95" should read --claim 97--.

Signed and Sealed this

Thirtieth Day of January, 1996

Bruce Lehman

*Attest:*

BRUCE LEHMAN

*Attesting Officer*

*Commissioner of Patents and Trademarks*